US011721514B2

(12) United States Patent
McKenzie et al.

(10) Patent No.: US 11,721,514 B2
(45) Date of Patent: Aug. 8, 2023

(54) X-RAY TUBE ANODE

(71) Applicant: OXFORD INSTRUMENTS X-RAY TECHNOLOGY INC., Scotts Valley, CA (US)

(72) Inventors: Christopher K. McKenzie, Half Moon Bay, CA (US); Yahya Alivov, Scotts Valley, CA (US); Mark Patton, Oxon (GB)

(73) Assignee: Oxford Instruments X-Ray Technology Inc., Scotts Valley, CA (US)

( * ) Notice: Subject to any disclaimer, the term of this patent is extended or adjusted under 35 U.S.C. 154(b) by 34 days.

(21) Appl. No.: 17/238,763

(22) Filed: Apr. 23, 2021

(65) Prior Publication Data

US 2022/0344121 A1 Oct. 27, 2022

(51) Int. Cl.
*H01J 35/08* (2006.01)
*H01J 35/10* (2006.01)

(52) U.S. Cl.
CPC ..... *H01J 35/112* (2019.05); *H01J 35/10* (2013.01); *H01J 2235/086* (2013.01)

(58) Field of Classification Search
None
See application file for complete search history.

(56) References Cited

U.S. PATENT DOCUMENTS 4,309,637 A * 1/1982 Fetter ..... H01J 35/02 313/40
4,352,196 A * 9/1982 Gabbay ..... H01J 35/153 378/135
7,769,139 B2 * 8/2010 Sakabe ..... H01J 35/10 378/123
8,879,690 B2 * 11/2014 Chaki ..... H01J 35/16 378/138
8,908,833 B2 * 12/2014 Nonoguchi ..... H01J 35/066 378/136
10,636,610 B2 * 4/2020 English, II ..... H01J 35/112
10,910,190 B2 * 2/2021 Jeong ..... H01J 35/065
2010/0080359 A1 * 4/2010 Sakabe ..... H01J 35/10 378/131
2012/0163548 A1 * 6/2012 Nonoguchi ..... H01J 35/10 378/125

(Continued)

FOREIGN PATENT DOCUMENTS

EP 3454 A * 8/1979 ..... G21K 1/025

OTHER PUBLICATIONS

Authors, et al. "Rotating Frame X-Ray Tube with Inertially Aligned Cathode". IP.com, IPCOM000255241D, pp. 1-5 (Year: 2018).*

*Primary Examiner* — Thomas R Artman
(74) *Attorney, Agent, or Firm* — Blank Rome LLP

(57) ABSTRACT

An anode for an X-ray tube is provided. The anode has a shape configured such that, in use: an electron beam impinges upon the anode at a focal spot on the surface of the anode, and the anode is heated by the electron beam from a first state to a predetermined second state and undergoes resulting thermal expansion causing a change in the location of the focal spot on the surface of the anode, wherein the configured shape of the anode is such that the spatial position of the focal spot with respect to the X-ray tube is substantially the same for the first state and the second state. A method of producing an anode for an X-ray tube is also provided.

15 Claims, 15 Drawing Sheets

(56) References Cited

U.S. PATENT DOCUMENTS

| | | | | |
|---|---|---|---|---|
| 2012/0163550 | A1* | 6/2012 | Chaki | H01J 35/147<br>378/136 |
| 2018/0315577 | A1* | 11/2018 | English, II | H01J 35/112 |
| 2020/0227228 | A1* | 7/2020 | Jeong | H01J 35/18 |
| 2022/0344121 | A1* | 10/2022 | McKenzie | H01J 35/08 |

* cited by examiner

X-RAY TUBE ANODE

FIELD OF THE INVENTION

The present invention relates to an anode for use in an X-ray tube, the shape of which is configured to improve the precision with which the position and alignment of the source of generated X-rays can be maintained during operation of the X-ray tube.

BACKGROUND TO THE INVENTION

X-ray tubes are employed as a controllable source of X-rays across a wide range of imaging and analytical applications. In many of these fields it is important to maintain precise alignment between the X-ray tube focal spot at which X-rays are generated, and coupled X-ray optics, collimators and similar apparatuses or detectors. However, in addition to generating X-rays, the operation of these instruments causes intense heating at the anode as it is struck by the high-voltage electron beam. Resulting changes in temperature can produce significant thermal expansion in X-ray tube anodes, and that expansion can alter the location of the beam focal spot, at which the beam impinges upon the anode, relative to the other parts of the X-ray tube. This movement of the spatial position of the source of generated X-rays within X-ray tubes can cause deleterious effects, including misalignment or de-focusing of the optical elements.

A number of applications require a reduced degree of X-ray spot movement during X-ray tube operation, coupled with high flux requirements. These include X-ray imaging and X-ray measurement systems, especially those requiring collimators that require stable X-ray flux output, including rotating anode applications. This is also relevant for X-ray fluorescence, as some application use X-ray optics to increase intensity at the sample. Examples of applications for which these requirements are of particular importance include high-resolution radiography, micro tomography, phase contrast imaging, and computed tomography.

Several techniques for addressing these requirements by reducing the unwanted thermal X-ray spot movement have been proposed. Conventionally, four main approaches are used, of which two are termed as "passive" and the other two as "active": (1) The user allows the tube and system to reach full thermal equilibrium before alignment is performed. This is a passive method. (2) Through careful design of the anode mounting arrangement and selection of materials with low, near-zero, or negative coefficients of thermal expansion, anode movement can be reduced by some degree. This is a passive method also. (3) Using simulations and temperature measurement of the anode, an actuator is employed in use to move the X-ray tube mount location in such a way as to compensate for the movement of the focal spot. This is an active method. (4) By way of measuring the spot location in use, beam steering elements within the X-ray tube are used to compensate for spot movement. Alternatively, the entire X-ray tube may be moved using actuators similar to method 3—this is an active method also.

Each of the existing compensation methods (1)-(4) carries disadvantages.

Method 1 requires long warm-up times, as well as continuous X-ray tube operation which reduces the longevity of an X-ray tube. Such continuous operation results in the filament and target being worn out through sublimation, and ultimately causes a loss of vacuum through outgassing of materials due to heating. These are normal failure modes for an X-ray tube, but continuous operation as required by method 1 accelerates these modes of degradation.

Method 2 requires expensive exotic materials, and furthermore the degree of movement reduction it can achieve is reliant upon the temperature of the mounting materials and the anode target changing temperature in a proportional way throughout the operating conditions. In practice these factors are difficult to predict or control, for the reason that some parts of the tube are closely coupled to the heat load from the X-ray spot, while others are only weakly coupled thereto and so also depend upon the temperature of the surrounding parts of environment. Different operating conditions outside of the control of the X-ray tube manufacturer, such as pulsed operation, can therefore change how and when the various components expand or contract and would not necessarily match conditions assumed during the design process.

Method 3 requires careful computer modelling, expensive computer and actuator control, and may not work well under conditions which require accelerated heating or cooling rates. Rapidly changing rates of heating or cooling, as would occur in short-duration, high-power applications, can, as with method 2, have an impact upon the exact rate at which materials in the relevant components expand or contract, depending upon a number of factors. In practice these are likely to differ from the original computer model used in the development of the computer control scheme. This method also relies on a mechanical actuation and supporting mechanical hardware, which cycle every time the tube is operated. In general, mechanical systems often fail before solid-state systems, and so reduced reliability is a risk with any moving mechanical system. In addition, the increased number of parts and subsystems introduces unforeseen failure mechanisms due to the added complexity.

Method 4 requires an expensive X-ray detection system, a computer or microcontroller, and a complex X-ray tube with beam steering features and complicated power supply or mechanical actuators. Since this method might also rely upon mechanical actuation, it would then additionally suffer from the same mechanical reliability issues as those associated with method 3. As with method 3, the increased number of parts and subsystems required for method 4 introduces unforeseen failure mechanisms due to the added complexity.

It is therefore desirable to find alternative solutions to the problem of X-ray spot movement caused by X-ray tube anode thermal expansion.

It is an objective of the present invention to provide an innovative approach to alleviating this effect to a degree that is unattainable by conventional methods, and to do so while obviating the need for any impractical, complex, expensive, or potentially damaging mechanisms, operational requirements, control processes, and modifications. The present invention is directed to enabling precise alignment of instruments with X-ray tube spots and simultaneously simplifying tube construction, expediting operation, improving performance, and reducing costs.

SUMMARY OF THE INVENTION

In accordance with a first aspect of the invention there is provided an anode for an X-ray tube, wherein the anode has a shape configured such that, in use: an electron beam impinges upon the anode at a focal spot on the surface of the anode, and the anode is heated by the electron beam from a first state to a predetermined second state and undergoes resulting thermal expansion causing a change in the location of the focal spot on the surface of the anode, wherein the configured shape of the anode is such that the spatial position of the focal spot with respect to the X-ray tube is substantially the same for the first state and the second state.

The inventors have realised that it is possible to overcome the above described issues with conventional anode designs by establishing how temperature changes experienced by an anode material in use, at least for two different states of temperature and thermal expansion, cause a displacement to parts of that material that affect the location of the intersection between the electron beam and the anode surface. It has been found that doing so permits the shape of the anode to be configured accordingly so that the displacement is significantly reduced or eliminated. In other words, in contrast with existing X-ray tube designs, the anode can be specifically shaped so that, when it is heated from a first, initial state to a second, operating state in use, thermal expansion at the part of the anode surface on which the beam of the X-ray tube impinges is in a direction corresponding to or aligned with the orientation of that surface, as defined by the initial and operating beam spot positions on the anode surface, such that heating to the first state to the second state causes substantially no displacement of the beam-anode intersection position.

Thus the anode enables X-ray tubes to be arranged wherein the high voltage anode geometry and attachment method effectively cancels movement of the X-ray spot location due to thermal expansion in the target. By way of reorganising, reshaping, and reorienting the anode, and arranging an X-ray tube with components in accordance with the redesigned geometry, the motion of the X-ray spot that would normally result from the thermal expansion of the components is greatly reduced. This is particularly advantageous when applied to instruments in which precise alignment between an X-ray tube focal spot and coupled X-ray optics, collimators, or similar devices or detectors are required.

This advantageous effect achieved by the present anode design is equal to, or better than, the degree of X-ray spot motion compensation that can be accomplished using the conventional active and passive techniques discussed above. Moreover the present approach does not necessarily require equilibrium conditions, long warm-up times, exotic materials, temperature measurements, actuators, X-ray detectors, electron beam steering, computer control, or algorithms, and therefore represents a significant benefit for implementing the aforementioned applications. Such advantageous anode designs also represent a departure from the conventional construction principles seen in standard glass X-ray tubes. Existing design approaches are based around simplifying the geometrical arrangement by way of configuring one of the geometrical elements, such as the electron beam axis, the anode axis, or the window axis, perpendicular to the other elements, and having those remaining elements parallel to one another. It has now been found that eschewing such geometrical simplicity in terms of anode and X-ray tube design, in favour of more complex geometries and anode topologies while necessitating a more complicated design and manufacturing process in most cases, gives rise to superior thermal X-ray spot movement compensation while also simplifying the construction of X-ray tube construction by way of obviating the need for conventional modes of thermal expansion compensation.

It will be understood that the "shape" referred to above corresponds to a geometrical shape of the anode. That shape may be configured in combination with other anode properties. For example, the shape, and the material, or material properties, of the anode may be selected, configured, or predetermined in accordance with one another. The anode shape, as well as any of these other properties, may be thought of as being configured or predetermined in order to achieve a configured or predetermined thermal expansion of the anode in response to heating in use.

As noted above, the focal spot may be defined as the intersection of the beam of the X-ray tube and the anode surface. The location of the spot may be defined by the intersection area, or a centroid of that area.

When in use in the X-ray tube, the anode being heated is caused by the impingement of the electron beam thereupon. The first state may also be referred to as an initial state, in that it corresponds to the beginning of a period of operation of the beam or X-ray tube, or more particularly to a period of heating of the anode in the above described way during operation. Typically the initial state corresponds to, or is chosen to be, the state of the anode prior to any heating by the beam. For example, the anode at the first state may be at room temperature, and it may be at thermal equilibrium. Typically this corresponds to a uniform, or substantially uniform, temperature distribution throughout the anode. The first state may, however, alternatively be defined as the state of the anode after a preceding, typically predetermined, degree of heating, or having been subjected to or being maintained under predetermined heat conditions. Such conditions need not necessarily correspond to room or ambient temperatures, or thermal equilibrium.

The first state, as well as other states of the anode referred to in this disclosure, typically corresponds to an anode temperature, or a distribution of temperatures throughout or across the anode. A state may comprise absolute temperature values for a given state, or values relative to another state, for example a temperature difference or difference factor throughout all or part of an anode, or a plurality of temperatures or differences.

These anode states may also be thought of as states of thermal expansion. For uniform, isotropic expansion, a relationship between two states may for example be represented by a scale factor value. Typically a state, or relationship between two states, may be represented in terms of movement of material or differences in a shape, surface topology, or geometry of at least part of an anode. This may be, for instance, relative to a given fixed point, such as a centroid of an area of, or fixings providing, attachment or mounting of an anode within an X-ray tube. It may be defined relative to another part of the X-ray tube. It may also be defined for a set of locations within the anode and additionally or alternatively on the anode surface. As with temperatures or temperature distributions representative of a given state, thermal expansion states may also be defined in terms of a set or distribution of absolute or relative values representing the expansion state for one or a plurality of locations within or on the anode. Such values may be representative of the magnitude and/or the direction of thermal expansion. Information about the difference between the first state and the second state defined in such ways allows the anode to be configured with the advantageous displacement-cancelling properties described in this disclosure.

The second state may be referred to as an operating state. The state may be understood as being predetermined in the sense that the state of the anode temperature and/or thermal expansion, or distribution thereof, for part or all of the anode, is known, in particular prior to use. It will be appreciated that this operating state, at least in terms of the spatial position of the beam focal spot therein, into which the anode is brought by heating in use, is typically determined in order for the anode shape to be specifically configured to reduce any spot movement as a result of that heating. By contrast with the operating state, the first or initial state need not necessarily be predetermined in all embodiments, since the first state may correspond to a state at a first instance of heating, or may be the same as the state prior to any heating by the beam. Thus the first state may comprise or correspond to less temperature information, for example, than the second state, since the second state typically needs to be established prior to the configuration of the anode shape. In some embodiments, the initial state may be predetermined in the same manner as the second state, for example if the first state corresponds to a state immediately after, upon, or caused by a predefined amount of preceding or initial heating.

For each of these anode states, the temperature distribution need not necessarily be quantified for all, or indeed any of the anode body. These states may, in some embodiments, be defined in terms of an expansion state, in absence of any specific temperature information, and such expansion information may comprise data representative of a degree of expansion, or an expansion distribution. In the second, or operating state, for example, in typical embodiments the anode temperature in the vicinity of the beam spot can approach the melting point of the material at the anode target. For tungsten, for instance, the temperature may be increased to around 3370° C. In such operation, the comparatively colder end of the anode, distal to the beam spot, may typically be at a temperature of 80-150° C. Moreover the temperature at such distal parts of the anode can be kept arbitrarily low in use, depending upon cooling techniques that are used in operation. The second state may typically comprise a temperature distribution such as this. A further example of a temperature distribution for a copper anode may involve the temperature proximal to the beam spot being slightly below 1083° C., that is slightly cooler than the melting point under typical conditions. Accordingly, in typical embodiments the second state comprises a temperature distribution which may include variations such as this along or across the anode body.

The said resulting thermal expansion, that is the thermal expansion resulting from or attributable to the heating of the anode by the beam, may be understood as causing the said change in that the location, upon the surface of the anode, of the beam spot is different for the first and second states. That is to say, the expansion in use causes the beam spot to be moved with respect to, or in the reference frame of, the anode, since the expansion causes the specific section of anode material at which the beam intersection occurs is changed as a result of the expansion. The advantageous shape of the anode may be configured such that this change does not result in the location of that intersection with respect to the X-ray tube, or a particular part thereof, being affected by the expansion. Typically the configured shape of the anode and the first and second states with which it is defined involve the electron beam axis position and orientation being the same for the first and second states, since typical embodiments involve use in an X-ray tube with a static electron gun and unmoving emitted beam axis.

The anode addresses the key problem of the apparent movement of the beam spot as it would be viewed from an X-ray tube window in use. It will be understood, therefore, that the key component of spot movement to be prevented is movement transverse to the X-ray emission axis, or window axis. This may be thought of as the location of the focal spot with respect to the X-ray tube being caused, by the specific anode shape, to be substantially the same, or the same in at least two dimensions orthogonal to the observation axis, for the initial and operating states. The observation axis or window axis may be defined as a straight line between the focal spot, or in particular the position of the focal spot when the anode is at the initial state, and the X-ray window of the tube, or a location or part, such as a centroid, thereof. Typically, however, in an X-ray tube the relative positioning of the anode, window, and beam, in particular with an arrangement wherein the observation or emission axis and electron beam are non-parallel, means that the shape is configured to maintain substantially the same spatial position for the beam spot for the first and second states in all three spatial dimensions.

The said spatial position of the focal spot with respect to the X-ray tube may be understood as a position or set of coordinates defined relative to any reference frame or point, typically external to the anode, in which a spatial translation may be seen to occur as a result of expansion of the anode in use. Thus the frame of reference with which this spatial position is defined may be based upon or fixed to any location or portion of apparatus that is substantially not caused to be moved or expand as the anode is. Since the key advantage afforded by the anode is the substantial elimination of beam spot movement relative to the window of the X-ray tube, the reference frame with which the spatial position is defined is typically a part of the X-ray tube, preferably an outer part of the tube, and most preferably the X-ray emission window.

The spatial position of the focal spot being substantially the same for the two states preferably corresponds to the initial spatial position and the operating spatial position at those respective states being sufficiently similar for there to be no observable difference between them, for example as viewed from the X-ray tube window. The anode shape is preferably configured such that the spatial position is the same for the first and second states, that is with spot movement being eliminated entirely. Typically, however, the substantial elimination of the spot displacement may be dependent upon or relative to the anode configuration and topology. For example, a typical application for an X-ray tube is micro-CT imaging. For such applications, a displacement of the beam spot between the first and second anode states in the order of a few microns might be problematic in that field of use. The present anode configuration may substantially eliminate the spot movement by way of reducing the displacement significantly, to a magnitude in the order of a single micron, or sub-micron distances, depending upon the physical dimensions of the anode.

By contrast, another example application might involve a comparatively large, rotating-anode system, wherein a spot displacement of around 100 microns can occur as a consequence of the extreme heating and physical dimensions involved in such arrangements. In such cases, depending upon the application, a reduction to this displacement, by using the present anode, may be achieved, bringing the displacement to a distance of 10-15 microns, thereby substantially eliminating the beam spot movement in the context of these larger applications. It will be understood, therefore, that the present anode design can substantially prevent displacement of the beam spot being the two states for a wide variety of applications and X-ray tube arrangements. Thus the spatial positions are substantially the same in that the movement of the spot due to thermal expansion is removed or minimised compared to the movement seen in typical topologies that are conventionally used with such implementations.

More generally, for some embodiments the maximum spot displacement can be expressed in terms of the dimensions of the anode, for a given anode material and power of the impinging electron beam in use. An example formulation for the magnitude of thermal expansion in an anode, for which the configured shape can be advantageously configured to compensate, can be made as follows. Firstly, a cylindrical anode shape is assumed. Secondly, in accordance with typical anode shapes, a diameter D of that cylinder is assumed to be less than 25% of cylinder length L. Thirdly, a uniform temperature drop along a portion of the anode of length L−D is assumed. Within a distance D of the spot, heat typically moves spherically outward and the expansion is difficult to calculate, and is not included in this calculation. For a beam power at the spot P, thermal conductivity of the anode $\lambda$, temperature in the heat sink $T_{hs}$, then the average temperature $T_{bar}$ of the anode within length L−D may be given as $T_{bar}=T_{hs}+2*(L-D)*P/(\lambda*\pi*D^2)$. The change in length of anode $\Delta L$ for this portion of the anode can be calculated given the coefficient of thermal expansion a and the initial temperature $T_0$, by $\Delta L=\alpha*(L-D)*\Delta T$, where $\Delta T=T_{bar}-T_0$. The change in length may accordingly be calculated by: $\Delta L=\alpha*(L-D)*(T_{hs}-T_0+(2*(L-D)*P/(A*\pi*D^2))$. For copper, for instance, $\alpha=17\times10^{-6}\ K^{-1}$, $\lambda=391$ W/mK. Assuming $T_0=20°$ C., $T_{hs}=100°$ C., L=0.04 m, D=0.01 m, P=50 W, the change in length is then 53 microns as the principal expansion. This equates to approximately 1.8 microns per mm length of the anode.

The magnitude of this principal expansion is dependent on the applied power. For a different case of an anode that is 150 mm long and 35 mm in diameter, with a power P of 500 W, the change in length due to thermal expansion is 306 microns as the principal expansion, or approximately 27 microns per centimeter length of anode.

Typically the lowest degrees of expansion occur for high-thermal conductivity, low-expansion materials, and with low power, and short length/large diameter anodes.

The configured shapes of anodes according to this disclosure are such that this expansion, as quantified in the foregoing example formulations, has a vastly reduced effect upon the spatial position of the beam-anode intersection than occurs in conventional arrangements. The configuration typically results in the displacement of the spot for the first and second states being less than or equal to 10% of the principal expansion of material at the (initial location of the) spot. Preferably the displacement is less than or equal to 5%, and more preferably less than or equal to 1% of the principal expansion. Accordingly, in some embodiments, the displacement of the spatial location of the beam spot with respect to the X-ray tube (or window/window centroid thereof) at the second state relative to the first state is typically less than a few microns per centimeter of anode length, or preferably less than one micron per centimeter of anode length. Typically the said displacement is less than 0.05%, preferably less than 0.01% of, and more preferably less than 0.005% of the anode length. The anode length may be defined, for example, as a distance from the mounting centroid to the distal or target end of the anode, or from that centroid to the spot location for example.

The shape of the anode may be configured to achieve the described effects based upon known, calculated, or predicted thermal expansion of the anode, or at least the resultant expansion that causes movement of anode material that intersects with the beam at, and preferably between, the first and second states. In this way it is possible to cause the beam to intersect with the anode surface at the same point in space relative to the X-ray tube after a given amount of heating, time, or under given heating conditions, as it does prior to that heating being applied.

Anode geometries may be generated that result in effectively zero spot displacement in use. Preferably the shape may be configured such that the spot position displacement at the two states is zero or less than any predetermined maximum. However, such a maximum threshold to the spot displacement is typically, in practice, defined by operational and practical factors. Such considerations include inter alia the degree to which the beam power can be regulated by the power supplied in use, the repeatability and manufacturing tolerances for assembling the anode apparatus with a specific geometry, variation in temperature in the external environment. If factors such as these, which can influence the physical changes experienced by the anode in use, can be controlled adequately, then the anode configuration can reduce the beam spot displacement to virtually zero. It will be understood, however, that physical variables such as the above described factors might, when the anode is used in an X-ray tube, result in some deviation from or preclusion of either or both of the precise first and second states, or rather the transition there between, being effected, and so might preclude the total elimination of beam spot displacement.

Nevertheless, despite the possibility in some embodiments or implementations of various physical factors causing a degree of deviation from the precisely configured expansion state transition, it has been found that anodes designed as described above attain a significant improvement compared with conventional anode topologies in similar imperfect operation conditions. For the purposes of comparison, an "end window" X-ray tube arrangement may be considered. Such arrangements are known, and are discussed later in this disclosure. Such a configuration involves the principal axis of thermal expansion at the anode target being aligned in the same direction as the window axis of the tube. Such arrangements typically result in less apparent beam spot displacement than conventional "side window" arrangements, which are also discussed and illustrated later in this disclosure. Compared with a typical end window arrangement, anodes with the specifically configured shape described above have been found to reduce the effects of thermal expansion upon the apparent beam spot location by a factor of 10. This improvement is greater in arrangements where the target is tipped, as is described in greater detail in relation to the examples described in this disclosure.

Although it is beneficial for the anode to be shaped such that no net displacement of the focal spot position occurs for the two respective states, preferably the shape is also configured so as to prevent movement, or preferably substantially, or, all movement, of the focal spot with respect to the X-ray tube during that transition. That is, the spatial position of the focal spot, when the anode is at an intermediate state in between the first and second states, or more particularly in the transition there between, is preferably the same as it is for the first and second states. By way of precisely configuring the anode geometry, it is possible to compensate for the heating and resulting expansion that occurs while the anode is heated from the initial to the operating state, preferably such that the focal spot location remains unchanged, or substantially unchanged, for part or all of that transition. This may be achieved by ensuring that a path on the anode surface traced by the beam spot during the heating and expansion transition from the first to the second state is a substantially straight line that is parallel to the principal axis of expansion, or is substantially so. In this way the movement of anode material attributable to expansion in the target region may be made to be tangential to the anode surface, such that there is substantially no expansion in a direction normal to the surface during the initial-to-operating state transition. Thus the position of the beam-surface intersection can be made to be substantially unchanging throughout that heating in operation.

Therefore, in some embodiments, the anode has a shape configured such that, in use, the electron beam of the X-ray tube impinges upon the anode at a focal spot that is in a target region on the anode, and at least a part of the surface of the anode within the target region lies along, or at least substantially along, a straight line coincident with the focal spot and parallel to a direction of thermal expansion of the anode at the focal spot. In some embodiments, the target region surface can be planar and aligned or substantially aligned with the said straight line. This straight line may be thought of as an expansion axis, defined by the direction in which movement of the material that is positioned at the focal spot at the initial state moves during the transition to the operating state during heating in use.

Preferably the said part of the target region surface lies along this straight line, that is to say a continuous portion of the straight line, or expansion axis, coincides with the target region surface. This may be thought of as there being a straight line on the surface, in use, that is collinear with a portion of the said thermal expansion axis. As will be described in greater detail later in this disclosure, in practice some deviation might occur in use, owing to non-uniform heating of the anode, such that the movement of the spot during the said transition is non-zero during at least part of that heating. For instance, if the principal component of the thermal expansion occurs in a substantially straight line, while the said non-uniform heating causes the anode surface in the target region to be non-planar or curved, then that curvature in the surface profile might give rise to such a deviation at one or more stages during heating from the first state to the second state. However, in such cases the surface may still lie substantially along the expansion direction axis, that is it may lie along that line to the extent that there is no observable separation at any point between the aforementioned surface line and the expansion axis, or in that the maximum separation or deviation that occurs is less than a desired acceptable tolerance distance.

The linear extent of the coincidence of the surface and the straight line is typically some non-zero, or finite length, the magnitude of which is typically configured to be, or correspond to, or be at least as long as, the distance moved by material along that part of the surface as a result of thermal expansion. The said straight line is preferably coincident with the location of the focal spot when the anode is at the initial state. It may also be coincident with the location of the focal spot at the operating state. More preferably, the line may be coincident with a spatial location of the focal spot at one or more immediate states corresponding to stages of heating of the anode between the first and second states. The said direction of thermal expansion refers to the direction in which the anode material mentioned above moves with respect to the X-ray tube typically, owing to thermal expansion of the anode in use. This thermal expansion may refer generally to expansion that occurs as a result of uniform or substantially uniform temperature change throughout the anode in use. In particular this expansion may refer to "principal" expansion which arises as a result of the overall heating of the anode. This principal component may be understood as a component of the total expansion, which may additionally include expansion effects arising as a result of highly localized or non-uniform heating, for instance proximal to the beam spot. In some embodiments wherein the non-uniform expansion components are negligible, the expansion axis with which the surface is aligned may be the principal axis of expansion. Preferably, however, non-uniform expansion effects, which can introduce localised shape changes to the surface geometry in addition to an overall increase in scale, are considered when configuring the anode shape. Accordingly, in such preferred embodiments the direction of thermal expansion with which the surface is aligned at the target refers to the axis of total or net expansion. This may comprise, for example, the initial state corresponding to a state at which a non-uniform deformation or shape change has been caused at a particularly hot part of the anode, in which case the overall anode shape may be configured such that this non-uniformly heated first state defines a beam spot intersection spatial location that is substantially the same as the location for the second state, which corresponds to the anode having been heated further still. This principle is illustrated in the examples described later in this disclosure.

It will be understood that thermal expansion occurring in the anode, or at least the principal component thereof, will be directed away from the location at which the anode is mounted or fixed to the X-ray tube. In particular the centre of such a fixing portion may be used as a reference from which to determine such expansion axes. Accordingly, therefore, in some embodiments, at least in use, the straight line is coincident with a centroid of an attachment region of the anode at which the anode is attached to the X-ray tube. The said centroid is typically the centroid of multiple locations, or the geometrical centroid or centre of locations, or fixings by which the anode is attachable or attached to the X-ray tube, or is attached to the tube in use. The centroid may also be defined such that, for a given change in temperature of the anode, the centroid undergoes no movement attributable to thermal expansion or contraction with respect to the X-ray tube.

As noted above, the temperature increase and resulting thermal expansion within the anode is not necessarily uniform throughout. A relatively higher temperature region may arise close to the source of heating, namely the beam, thereby causing a greater degree of expansion in the vicinity of, and typically centred around, the focal spot. For a planar target region of the anode surface, for example, non-uniform heating may result in a bulge, peak, or protrusion out of that plane caused by higher temperatures underneath that part of the surface than in parts of the anode regions further from the beam spot. In preferred embodiments, the shape of the anode is configured to compensate from these effects.

For instance, the anode may be shaped such that, when it is mounted in the X-ray tube, the non-uniform heating causes the target region surface to be positioned and oriented such that further heating of the anode, to the second state, will result in substantially no displacement of the beam spot with respect to the X-ray tube when that state is reached. The first state may, as alluded to above, therefore be defined or established as including some expansion components attributable to this non-uniform heating. Preferably the orientation of the target surface is offset from the principal axis of thermal expansion prior to the anode being heated to the initial state in such cases. This may be configured such that the non-uniform heating occurring as a part bringing the anode to the initial state causes non-uniform bulging around the spot, such that the target region surface is brought substantially into alignment with the principal expansion axis, thereby effectively cancelling the configured offset from the principal expansion axis. By introducing such compensatory considerations, the anode may subsequently undergo further heating in use, from the heated first state to the further heated second state, such that further thermal expansion occurring as a result of that transition is, or is substantially, entirely aligned with the principal expansion axis.

In other words, preferred embodiments employ correction for localised deformations in use by way of the configured shape of the anode target region and/or the orientation of the anode within the tube being such that localised heating to the first state for example brings the surface orientation substantially into alignment with the direction of thermal expansion between the first and second states. To achieve this, either or both of the configured shape of the anode, particularly the target region, and the orientation at which the anode is mounted or mountable within the X-ray tube, can be configured with such a corrective geometry.

It will be understood from the foregoing description that, in embodiments such as these, the said non-uniform heating proximal to the beam spot occurs in use in the sense that it occurs during exposure of the anode to the beam sufficiently for localised thermal expansion to cause the said change to the orientation of the surface and bring the surface into the defined alignment for the first state.

In some such embodiments, preferably the said configured shape is such that, in absence of the said non-uniform heating, that is when the surface profile is substantially unchanged by any localised temperature change proximal to the focal spot, a predetermined deviation angle is formed between the orientation of the said part of the surface of the anode and the straight line, the predetermined deviation angle being configured to be substantially equal in magnitude to a change in inclination of the surface of the anode proximal to the focal spot caused by the said non-uniform heating. This deviation may be predetermined in that it is typically known before a given use of the anode, and can for example be calculated as part of designing, refining, or modifying the anode shape and additionally or alternatively the mounting orientation of the anode in accordance with a change in the inclination that may be calculated or monitored in use. The orientation of the said part of the surface may be understood as specifically being a line along that part of the surface that, in use, or at least at the operating state, lies substantially parallel to and coincident with, the said straight line or expansion axis, particularly the principal expansion axis. In some embodiments, the predetermined deviation angle is effected as a tilt correction of 10 degrees, for instance. It has been found that the application of a tilt angle to compensate for a peak forming on the target surface can reduce focal spot displacement by a factor of 10, for example in an "end window" configuration as mentioned earlier in this disclosure.

Non-uniform heating experienced by the anode in use may include, in addition to a localised protrusion or bulge proximal to the beam spot, an additional deformation of the anode caused by a non-uniform axial cross-section and consequent non-uniform thermal gradient. The occurrence of this so-called "banana effect" typically depends on the geometry, and more specifically the symmetry, of the anode, and is not expected to arise in symmetrical anodes. That is to say, typically, for an anode that is symmetrical with respect to some plane, wherein the spot is coincident with that plane in use, the total expansion direction lies within that that plane. This is typically the case regardless of non-uniformity of heating and can always be resolved into two components: one that is normal to the target and one that is along the major axis of expansion (not necessarily perpendicular to each other). If the length within the anode of the principal axis of expansion is larger than the expansion normal to the target, it is generally possible to configure and mount the anode so as to orient the major expansion direction such that a component of this expansion exactly cancels the expansion normal to the target. This may be difficult, however, if the major expansion is small and approaches the expansion normal to the target.

In embodiments wherein the target does not have a plane of symmetry, the target may expand in such a way as to carry some non-coplanar part of the geometry into the path of the beam, thereby causing movement of the beam spot. However, for a stationary (that is, non-rotating) target it is possible to compensate for this effect by including in the configured shape of the anode further constraints on the orientation of the target plane. Similarly to how a predetermined deviation angle may be effected so as to apply a first tilt angle that corrects for bulging proximal to the beam spot, in some embodiments the predetermined deviation angle may also include a component to compensate for this deformation that may occur in asymmetrical anodes. Accordingly, a second tilt angle, perpendicular to the first tilt angle, may be defined and oriented to compensate for the expansion of the target face that would otherwise cause spot displacement.

The reduction in focal spot displacement that may be achieved by configuring anode shapes as described above may be understood by comparison with an alternative, conventionally shaped anode. Such a notional second anode, when used under the same X-ray tube conditions as the first anode, typically exhibits measured or expected focal spot displacement that is in order of magnitude greater than the displacement occurring between the first and second states for the anode according to the first aspect. Preferably, the distance between the spatial position of the focal spot with respect to the X-ray tube for the first state and the spatial position of the focal spot with respect to the X-ray tube for the second state is therefore less than or equal to 10% of a distance between: a spatial position, for the first state, of a focal spot for, on, or that would impinge on the surface of, a second anode when in use in the X-ray tube, the second anode having a shape configured such that its principal axis of expansion as defined for the beam spot in use or at the first state in particular, that is the direction of movement of material at the anode surface attributable to thermal expansion when heated from that first state to the second state, is parallel with a window axis of the X-ray tube; and a spatial position, for the second state, of the focal spot for the second anode with respect to the X-ray tube. The first and second states in relation to the second anode may be understood as the same heating and/or operating conditions being applied to the second anode as applied to the first anode that cause the first anode to be at the first and second states of temperature distribution/thermal expansion distribution respectively. These states may also be understood as being identical or equivalent first and second states of temperature and/or thermal expansion as those described in relation to the first anode.

The aforementioned substantial elimination of focal spot displacement may be understood in particular with reference to the typical dimensions of anodes in common X-ray tube applications. For example, a typical example anode may have a length, defined along the direction from the anode mounting location in the tube to the target end of the anode of around 150 mm. Such an example anode may have a diameter, transverse to that longitudinal direction, of around 10 mm. The expected magnitudes of focal spot movements may be understood by considering the thermal conditions and materials involved in the use of such anodes. Because a typical copper anode would melt at 1083° C., thus effectively defining the maximum temperature for that anode, a relative upper limit on the expansion of such an anode may be defined. With a relatively low-temperature end of anode having an operating temperature of around 100° C., and the higher-temperature end having an operating temperature of 1080° C., the average temperature of the anode will typically be around 590° C. assuming a simple cylindrical anode structure. The coefficient of thermal expansion of copper is 18 microns per metre of length per degree Celsius. With a starting temperature of 20° C., and accordingly a temperature change in use of 570° C., the total expansion of the anode may be expected to be less than 100 microns per centimetre of anode length, that is length as defined by distance from the centroid of the mounting location to the target or beam spot. From this an upper limit to the expected expansion may be estimated as such for this example. This corresponds to an upper limit, whereas, with lower operating temperatures, for example an average anode temperature of 110° C., an expansion magnitude of around 20 microns per centimetre of anode length might be expected. With the configured shape described above, it is possible to ensure that the geometry of the anode and the expansion occurring therein cooperate or work in unison so that the expansion does not substantially affect the location at which the beam intersects with the anode target. In preferred embodiments, the distance between the spatial position of the focal spot with respect to the X-ray tube for the first state and the spatial position of the focal spot with respect to the X-ray tube for the second state is less than or equal to $1.5\times10^{-3}$ m. An upper limit of this magnitude might be applicable for particularly long anodes operating at very high temperatures, for example. For somewhat smaller-anode and/or lower-temperature cases, this distance may be less than or equal to $6\times10^{-4}$ m. Preferably, this distance is less than or equal to $3\times10^{-4}$ m, more preferably less than or equal to $1\times10^{-4}$ m, and more preferably still less than or equal to $5\times10^{-5}$ m. It will be understood that such tolerance values for substantially eliminating the spot displacement may be proportionally smaller or larger for anodes that are smaller or larger in size, respectively, than the typical dimensions discussed above.

The anode design principles which enable the above described advantageous effects are equally applicable to rotating-anode X-ray tubes as they are to stationary-anode arrangements. In some embodiments, therefore, the anode is adapted such that at least a portion of the anode, including the target region, is rotatable with respect to the X-ray tube, thus it is adapted to be rotated in use. This may be understood as the anode being arranged such that, in use, the focal spot moves with respect to a rotating portion of the anode, around the surface of the anode as the latter rotates with respect to the X-ray tube, with the anode preferably being rotationally symmetrical such that the focal spot is not caused to move with respect to the X-ray tube by rotation of the anode. In such embodiments preferably the configured shape of the anode is rotationally symmetrical such that, in use, during rotation of the said rotatable portion with respect to the X-ray tube, and preferably throughout, or substantially throughout, an entire rotation thereof, the spatial position of the focal spot with respect to the X-ray tube remains substantially the same for the first state and the second state. Thus, with respect to the rotating anode portion, in use the beam spot intersection location sweeps a circular path on the surface with the rotation axis at its centre. The position and orientation of that circular path on the anode is typically substantially the same with respect to the X-ray tube for the initial and operating states.

The application of the advantageously configured anode geometry to rotating-anode embodiments may be thought of as, the configured shape that substantially prevents displacement of the intersecting anode surface along the beam axis as anode material is heated from the first to the second state being symmetrically applied to the anode portion about the rotation axis, such that at a plurality of, or all, rotation states of the anode portion, that configured shape is maintained relative to the beam.

In some embodiments, for example, non-uniform expansion may occur in a rotating anode as described in relation to anodes more generally above. Typically such effects are manifested as an annular ridge around a rotating anode portion, rather than a single peak. Such a ridge may be corrected for by way of modifying the angle of the target region, in particular with respect to the rotation axis. In some rotating-anode embodiments, the rotational symmetry of the anode is therefore such that, in use, during rotation of the said rotatable portion with respect to the X-ray tube, at least a part of the surface of the anode within the target region remains lying substantially along the said straight line coincident with the focal spot and parallel to a direction of thermal expansion of the anode at the focal spot. This direction of thermal expansion may be defined as a net or average thermal expansion effect that occurs as the anode is rotating in use, but as defined for a given location on the anode surface under the beam at a given time or rotation state.

Such anodes may, in other words, be shaped such that, at any given stage during a rotation cycle of the rotation portion, the surface of the anode on which the beam is impinging is substantially parallel to the direction of thermal expansion of the anode material at the focal spot. Conventional rotating anodes are typically shaped to have infinite-order rotational symmetry at least in the area on which the beam impinges in use. In the present embodiments, such symmetry is typically effected so as to maintain the advantageous thermal expansion direction-surface alignment throughout that rotation.

Generally, for embodiments in which at least a part of the surface of the anode within the target region lie substantially along the said straight line coincident with the focal spot, this alignment may be understood as, for at least one of, and preferably a plurality of, and more preferably all of, intermediate states between the first and second states (when heated from the former to the latter), the location of the focal spot with respect to the X-ray tube is substantially the same. This may be defined in terms of a maximum variation that occurs in the position in space of the focal spot over the at least one intermediate state, or over the initial, operating, and intermediate state or states. Such configurations, when applied to typical anodes having dimensions similar to those described above, may be defined. For example, typically the maximum distance between the said part of the surface of the anode within which the target region lies and the said straight line is less than $1.25\times10^{-3}$ m. Preferably that maximum distance is less than $8\times10^{-4}$ m, more preferably less than $2\times10^{-4}$ m, and more preferably still less than $2\times10^{-5}$ m. In this way the maximum expected change in spot position, for example because of curvature or a non-linear inclination induced in the anode surface profile by non-uniform heating under the beam, can be configured with a maximum tolerance. In other words, the maximum deviation expected between the expansion axis and the anode surface in the relative target region for typical X-ray tube and operation times can be quantified as such. As has been discussed earlier in the disclosure, the movement of the target surface perpendicular to the plane of the surface can be complex, owing to the highly localised heating under the beam. The geometrical effects of this may depend upon the power of the beam impinging at the spot, the spot size, and shape, the thickness of material at the target, and the target material properties. Typically, the greatest degree of spot movement occurs with the largest spots and at the highest beam powers. The maximum power is typically limited by the evaporation rate of the target material and the melting point of the anode material, which is typically copper, as noted earlier. If, for example, a target has a lower coefficient of thermal expansion than the anode as a whole, then the thinner the material is, the greater the degree of expansion that may be expected to occur at the target surface due to expansion of the underlying material. By way of some example values for typical dimensions and materials, an upper limit for this expansion may be 20 microns for a 1 mm-diameter spot with a 25 micron-thick tungsten target at a beam power of 565 Watts. A power level greater than this may cause melting in a copper anode for example. Larger-diameter spots may produce thermal expansion that follows approximately the relationship: expansion (microns)=[0.0151×spot size (microns)+4.7 (microns)]×power (Watts)/565 (Watts). This equation is based upon an assumption that the power is adjusted to maintain an anode temperature slightly below the melting point of copper.

For embodiments including configured alignments as described above, preferably the distance between the said part of the surface of the anode within which the target region lies and the said straight line does not exceed the said maximum distance, for/along a portion of the straight line that is at least 5 microns in length. This corresponds to a typical amount of expansion in the principal expansion direction of material in the target region. Preferably, distances along the expansion direction that the anode surface conforms to the expansion axis in use may be configured to correspond to the degree of displacement of material at the spot attributable to expansion when the anode is heated from the first state to the second state. In other words, the linear extent of the surface plane-expansion direction alignment can be configured to be at least the distance at which the anode material at the initial beam spot is expected to move during the first- to second-state expansion. Additionally, this may be related to or configured in conjunction with the tilt correction as described earlier.

From the example estimated values set out above, and with an assumed approximate maximum tilt correction of θ, the minimum length of anode required to correct for a given amount of surface expansion at the target is typically: length (mm)=expansion at spot (microns)/tan (θ)×2.0 (microns/mm). For example, a desired maximum tilt correction of 10 degrees with 5 microns of target expansion at the spot would require a 14.2 mm-long anode. Therefore, in order to reduce the tilt angle required, longer anodes are typically necessitated.

In some embodiments, the second state corresponds to a predetermined temperature distribution within the anode that is achieved by way of the anode being heated under a predetermined set of heating conditions. The said distribution may be for all or part of the anode. Values of the temperature need not necessarily be predetermined. In some embodiments, this state may be predetermined by way of being defined by predetermined conditions, rather than, or as well as, expansion and/or temperature information being recorded or otherwise known. In such cases, by configuring the anode shape to eliminate substantially spot displacement when the anode is heated to a second state as defined by the conditions under which that state is reached, it is possible to reproduce the precise, substantially zero-displacement, operation repeatedly and reliably by applying the operating conditions defining the predetermined second state.

In some such embodiments, for example, the predetermined set of heating conditions comprises any one or more of average anode temperature increase, for instance monitored or inferred values, total applied electron beam energy, average electron beam power, and electron beam impingement duration. As described earlier in this disclosure, the operating state may correspond to an equilibrium state that may, for example, be reached with a given electron beam power after a given amount of time. The state may correspond, alternatively, to a transition state, and such a state might be reached after a given amount of heating or for a given operating duration.

In accordance with a second aspect of the invention there is provided an X-ray tube comprising an anode according to the first aspect. Typically the configured shape of the anode is based in part upon the position and/or orientation of one or more elements of the X-ray tube. Moreover, the X-ray tube according to the second aspect may be modified or configured in accordance with the configuring of the anode shape in order to optimise further the advantageous spot displacement elimination effect it achieves.

In accordance with a third aspect of the invention there is provided a method of generating X-rays using an X-ray tube according to the second aspect, the method comprising: causing an electron beam to impinge upon the anode at a focal spot on the surface of the anode so as to generate X-rays and to heat, or while heating, the anode from the first state to the second state.

Typically, the method further comprises continuing to operate the X-ray tube so as to generate X-rays, under a set of operating conditions whereby the anode is maintained at the second state. Typically such a mode of operation comprises the second state corresponding to an equilibrium state. In this way, continued use of the anode may be prolonged, with the minimised or eliminated movement of the beam spot resulting from the advantageously configured anode shape being achieved.

In accordance with a fourth aspect according to the invention there is a method of producing an anode for an X-ray tube, the method comprising: configuring the shape of the anode, the said configuring comprising the steps of: a) obtaining input anode shape data representative of a shape of an X-ray tube anode; b) identifying, based on the input anode shape data, a first location, on the surface of the anode, of a focal spot at which an electron beam will impinge in use when the anode is at a first state; c) identifying, based on the input anode shape data, a second location, on the surface of the anode, of the focal spot, when the anode, in use, is at a second state having been heated thereto by the electron beam from the first state and having undergone resulting thermal expansion such that the first and second locations on the surface of the anode are different; and d) generating, based on the input anode shape data and the identified first and second locations, modified anode shape data representative of a modified shape of an X-ray tube anode, wherein the spatial position, with respect to the X-ray tube, of the first location on the surface of the anode having the modified shape when the anode is at the first state is substantially the same as the spatial position, with respect to the X-ray tube, of the second location on the surface of the anode having the modified shape when the anode is at the second state, and forming an anode according to the modified anode shape data.

The obtaining of input anode shape data at step (a) may be by way of simulation, modelling, measuring, or otherwise obtaining from an anode. The first location, identified as step (b) may, for example, be a location, point, or set of coordinates or other indicator or data representative of where the focal spot will be produced. This may be based upon input or assumed X-ray tube element positions and orientations for example. As explained in relation to preceding aspects, the first state is typically prior to heating, for example with the anode at a uniform or ambient temperature, or it may be a state achieved after a predetermined amount of use in the X-ray tube or an application of predetermined initial heating conditions. The identifying of the first and second positions may typically be performed by way of modelling or simulating the total expansion effects, or the net expansion experienced at the relevant parts of the anode at least, proximal to the target. The generating of modified anode shape data may be performed by way of applying a modification to the input geometry in order to reduce the distance between the spatial positions of these surface locations. By making such modifications, it is possible to arrive at an anode geometry in which the movement of the beam spot for those first and second states as configured is eliminated or substantially so. Thus an anode having a shape identical or substantially identical to the shape represented by the modified anode shape data may be formed, and advantageously used in an X-ray tube.

Typically steps (a)-(d) are performed iteratively, prior to the forming of the anode. Generally this is carried out in order to enable an anode shape to be generated that is optimised for a given X-ray tube. Several iterations may be required in order to arrive at an anode topology that is suitable for the constraints or geometrical requirements configured for or imposed by a particular X-ray tube arrangement while also meeting the desired spot movement elimination requirement. In each iterative cycle, additional geometrical changes necessitated by modifications to the anode shape may be taken into account. Typically, each iteration determines the tilt angle required to remove the effects of surface target expansion for the initially estimated anode geometry. The second step may be performed after the design has been modified to include such a tilt angle while keeping the desired target-to-window angle constant. Since each step may require modification to other geometrical parameters within the tube, in order to accommodate this change in angle, for example the anode length, attachment location, other small, additional effects that are typically unknown during performing the preceding step will occur typically. Each iteration step preferably requires smaller adjustments than the preceding step, and the iterative process may proceed until such calculated changes to the modified anode shape data are less than the desired required maximum spot movement, or less than established manufacturing tolerances, for example.

In some embodiments, the generating modified anode shape data comprises: calculating a modification to the shape represented by the input anode shape data to reduce the distance between the location, with respect to the X-ray tube, of the first position on the surface of the anode having the modified shape when the anode is at the first state and the location, with respect to the X-ray tube, of the second position on the surface of the anode having the modified shape when the anode is at the second state; and applying the calculated modification to the input anode shape data so as to obtain the modified anode shape data. As noted above, the generating modified anode shape data may comprise calculating a modified tilt angle as described earlier in relation to correcting for non-uniform heating occurring in use.

The input anode shape data typically comprises a set of parameters having values, the parameters comprising: a window angle parameter representative of an angle between the anode axis, or the principal axis or total axis of expansion, and the window axis (which may be defined as a straight line joining the focal spot location and the centre of the window of the X-ray tube); and a target tilt parameter representative of an angle between the anode axis and the anode surface at the target region or the focal spot. Typically, in such embodiments, the generating the modified anode shape data comprises adjusting the values of the window angle parameter and the target tilt parameter such that the angle between the window axis and the anode surface at the target region is unchanged.

The configuring of the shape of the anode may further comprise: identifying, based on the input anode shape data, a straight line coincident with the focal spot and parallel to a direction of thermal expansion of the anode at the first position resulting from heating by the electron beam from the initial state; and wherein the said generating is performed such that, for the shape represented by the modified anode shape data, at least a part of a target region in which the electron beam impinges on the surface of the anode in use lies substantially along the straight line when the anode is at the initial state.

BRIEF DESCRIPTION OF THE DRAWINGS

Examples of the present invention will now be described, with reference to the accompanying drawings, wherein like reference numerals indicate like features, and in which.

DESCRIPTION OF EMBODIMENTS

Figure 1:
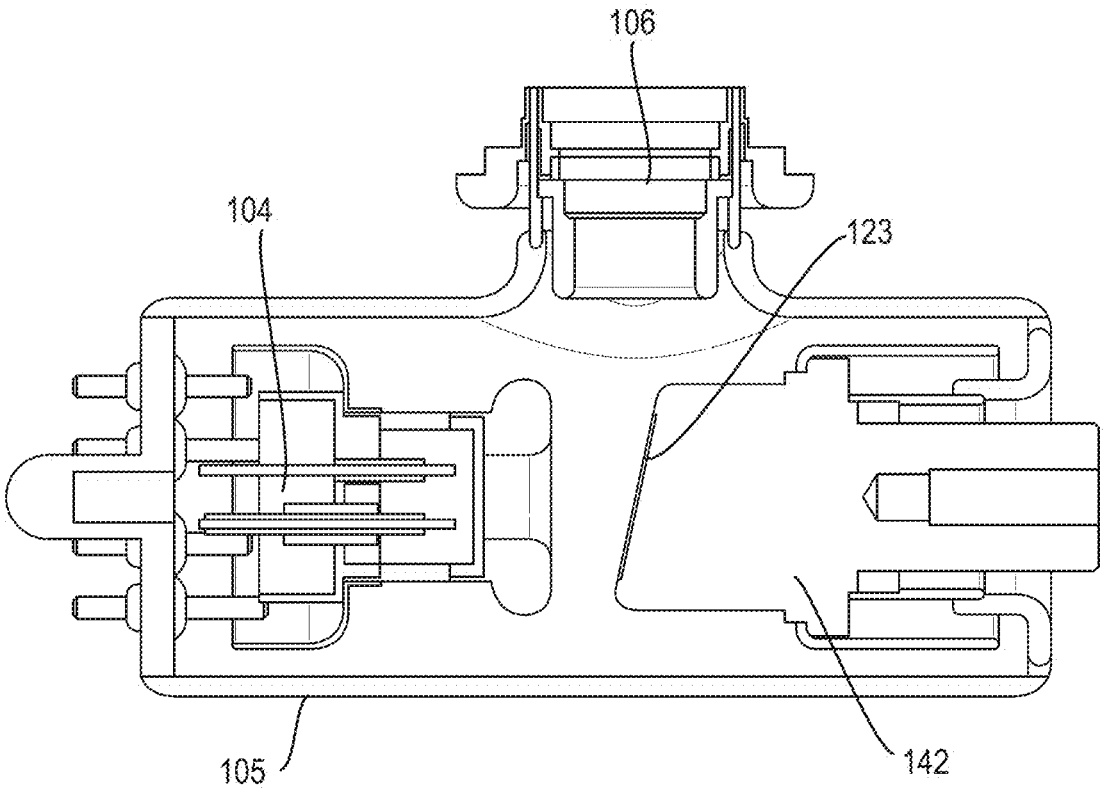
Fig. 1 Prior Art
FIG. 1 is a cross section view of a typical X-ray tube according to the prior art.
Figure 2:
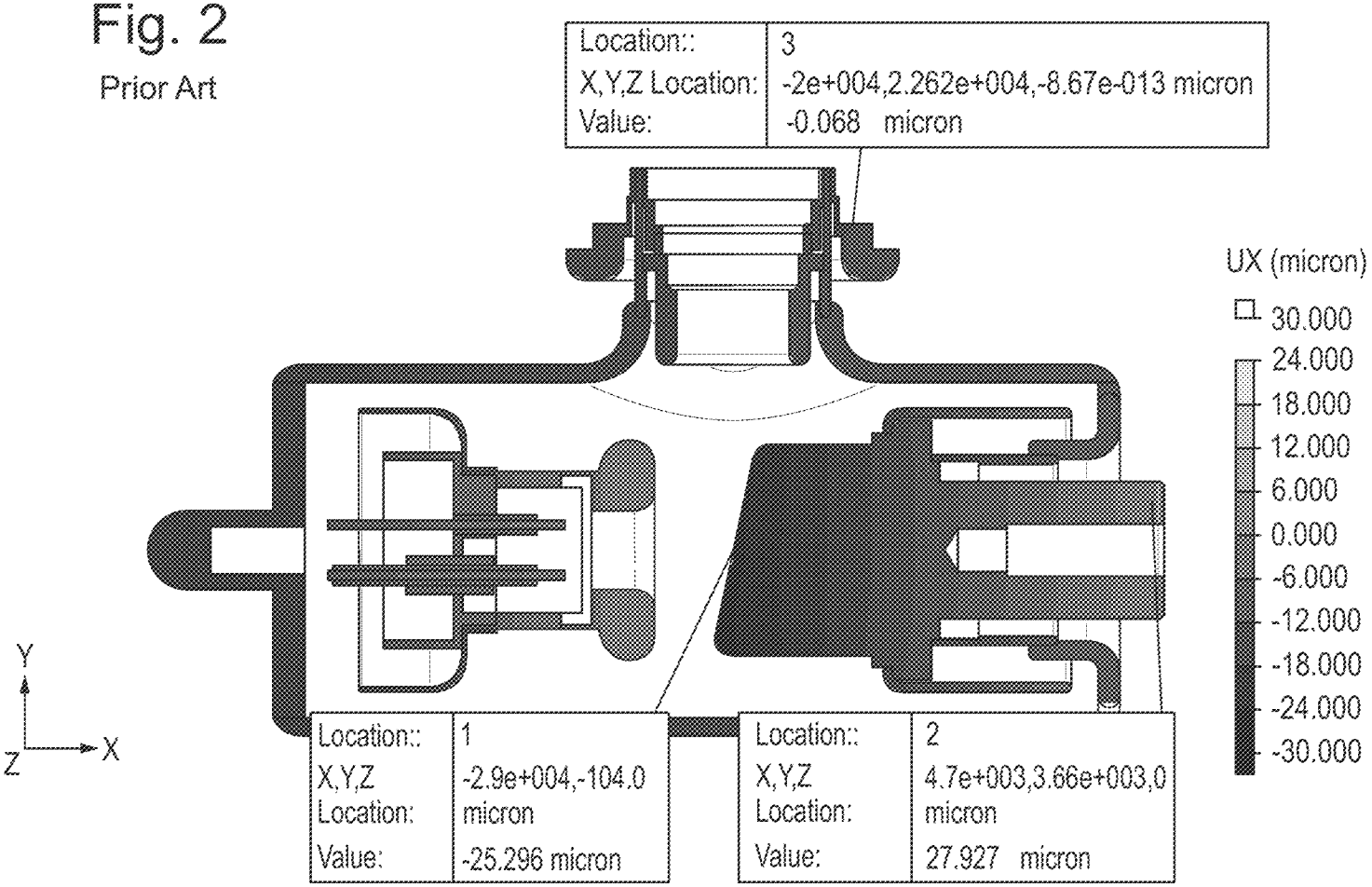
Fig. 2 Prior Art
FIG. 2 shows simulated thermal expansion in the horizontal direction within the X-ray tube according to the prior art.
Figure 3:
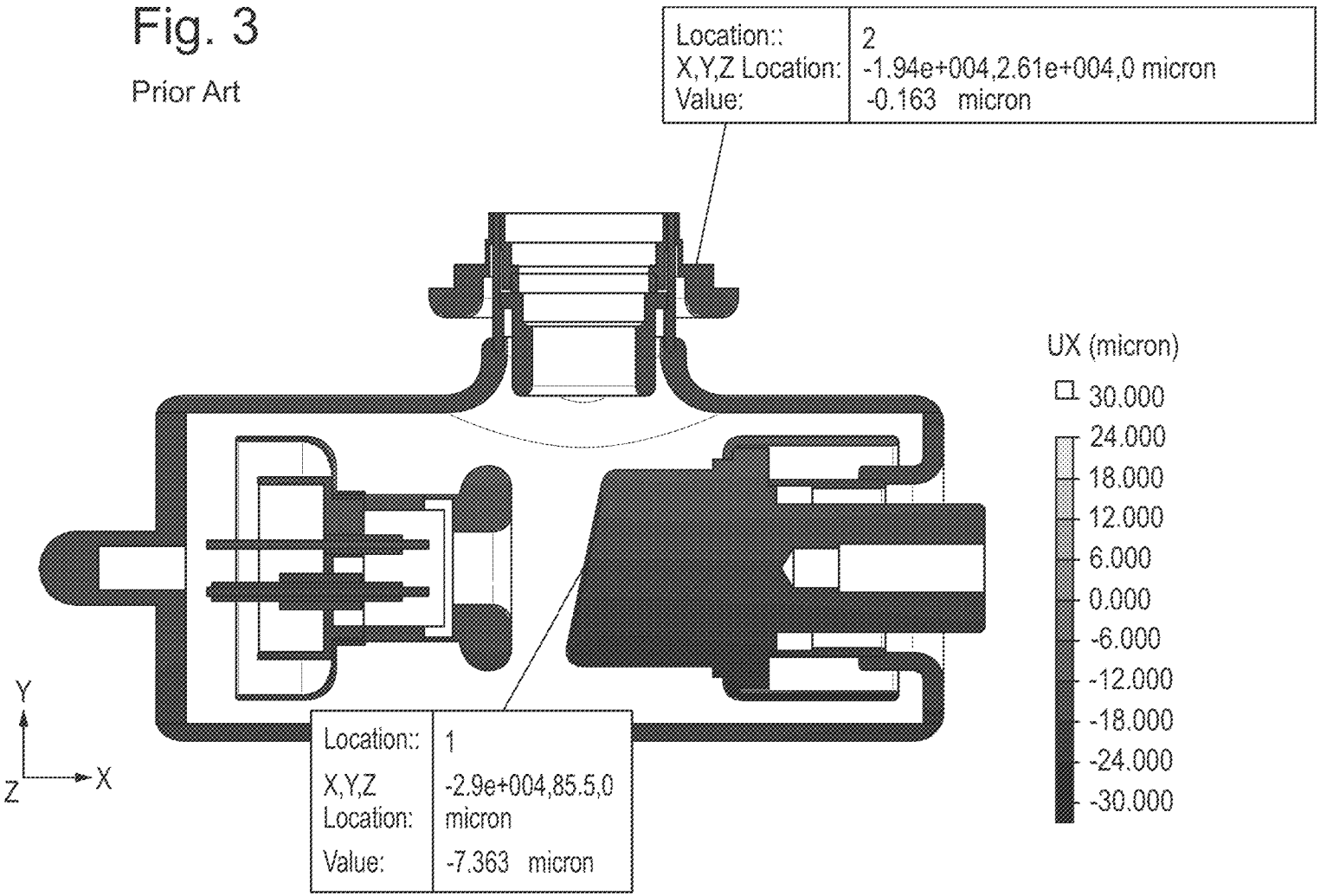
Fig. 3 Prior Art
FIG. 3 shows simulated thermal expansion of the prior art X-ray tube elements in the vertical direction.

FIG. 1 shows a cross-section of a typical existing X-ray tube and anode with a "side window", stationary target, reflection target arrangement. The electron gun 104 is shown at the left of the figure, with the anode 142, and target surface thereof 123, being shown on the right. The X-ray window 106 is at the upper part of the figure. FIG. 2 shows simulated values, obtained by way of a finite element analysis simulation, for thermal expansion of the components of this conventional X-ray tube and anode arrangement. FIG. 2 shows thermal expansion in the vertical direction as depicted, of FIG. 3 shows the vertical components of the thermal expansion. As can be seen from this visualisation, the expansion in the components of the tube, in particular the anode surface, that results from heat dissipation of the electron beam in the target, relative to the centre of the window cause the apparent position of the focal spot from which resulting X-rays are omitted, to shift during the operation of the tube. Due to the expansion in the horizontal direction, the location at which the X-rays are generated thus shifts to the left in the depicted example. This beam spot movement, that is transverse to the viewing or window axis defined by the position of the window 106 relative to the target surface 123, can cause misalignment with optical elements. Movement of the beam spot in the vertical direction can, to a lesser degree, also cause misalignment or defocussing of the optical elements.

Figure 4:
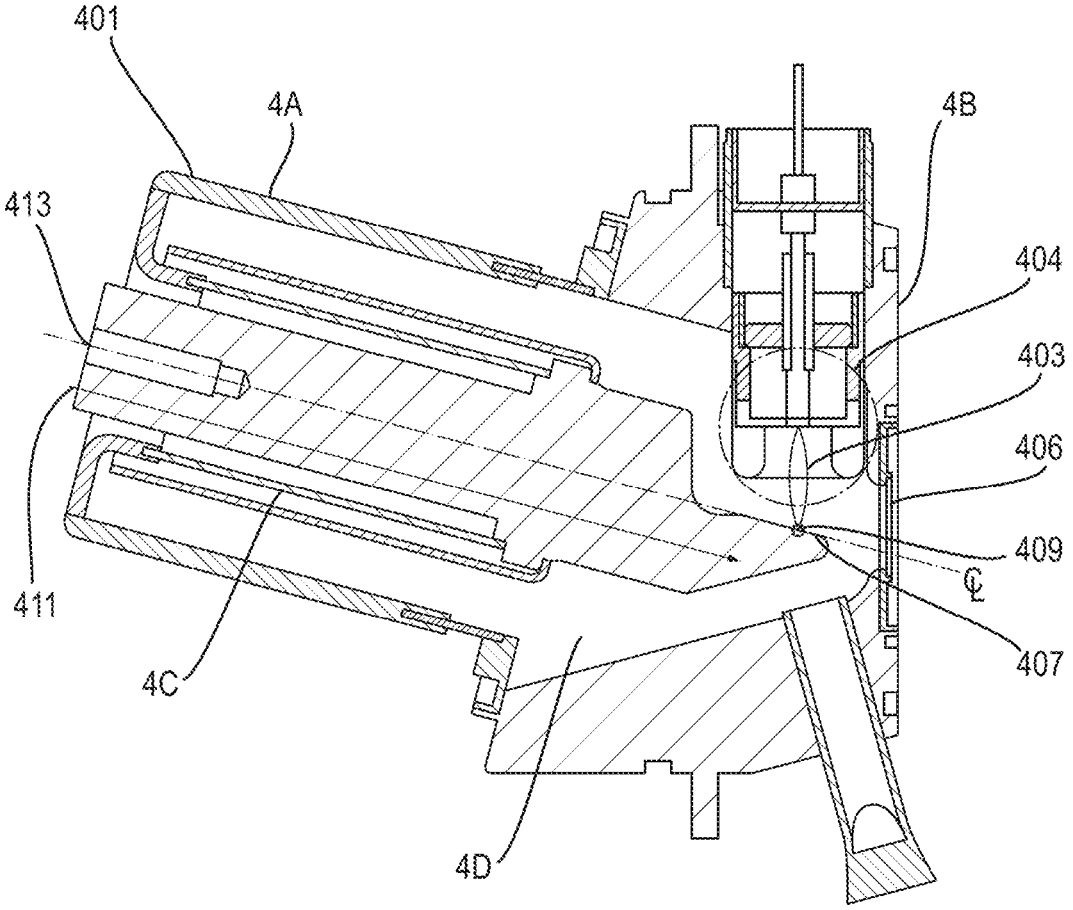
FIG. 4 is a cross section showing a first example anode according to the invention within an X-ray tube.

These deleterious effects are alleviated by the present invention. A first example anode is now described. FIG. 4 shows a first example anode 401 according to the invention. The high-voltage anode is shaped such that the target region 409 of the anode surface is on a plane which is coincident with and parallel to the direction of thermal expansion 411. This principal expansion axis of material at the beam spot 407 can be defined as the straight line joining that spot with the mounting centroid location 413, away from which thermal expansion of anode material is principally directed. This arrangement illustrates a manner of realizing a key concept of anode designs according to this disclosure, in that the thermal expansion of the anode along the plane of the target surface does not affect the position in space of the electron beam 403 impact location, that is, the intersection of the beam and the anode, relative to the X-ray window 406. This configuration results in a vast reduction in movement of the focal spot 407 as the anode is heated in use from a first state, corresponding in this example to an initial start-up low temperature equilibrium condition, to a second state corresponding to a condition of high-temperature equilibrium. Moreover, to a lesser degree, the displacement of the spot from its location at the initial state is also reduced for any non-equilibrium conditions in between the initial and high-temperature equilibrium states.

Figure 5:
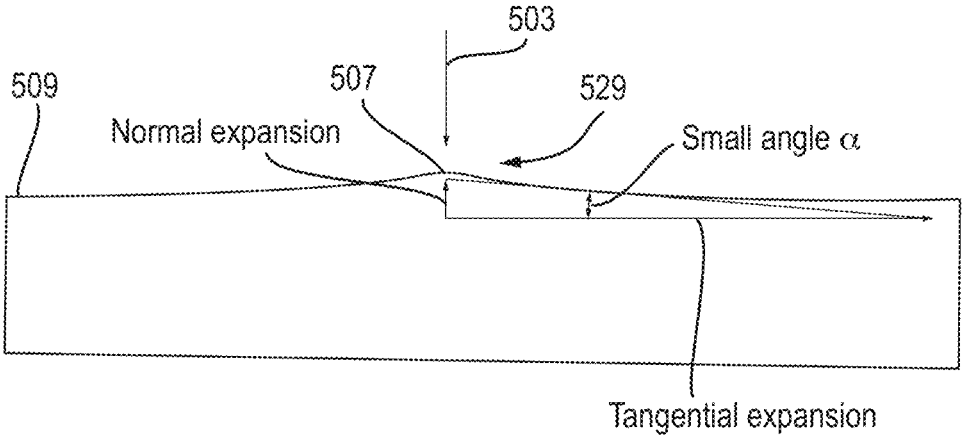
FIG. 5 shows a section of a target surface of the first example anode.

However, in the present example, because the heating and resulting thermal expansion is not homogeneous throughout the anode body, with the region around the focal spot being hotter in use than other parts of the anode, an additional component of thermal expansion also occurs in a direction normal to the target face 409. FIG. 5 shows a cross section of a horizontally oriented target in which the vertical dimension is highly exaggerated for illustrative purposes. The peak on the target surface 509 is located under the electron beam 503 and shows how the target material expands toward the electron beam due to extreme heating and thermal expansion of the material directly under the beam spot 507. In addition to this normal expansion component, in use the material moves tangentially to the surface owing to the principal expansion component. This tangential expansion is significantly greater in magnitude than the normal component, despite the less extreme temperatures that cause it, because of the large size of the anode compared to the localized peak region 529. The combination of these two expansion components define a small tip angle $\alpha$. In order to compensate for the small additional thermal movement of the surface toward the electron beam, in some examples the target surface may be tipped slightly in relation to the principal axis of thermal expansion. The tip angle to be applied when configuring the anode can be calculated as the arctangent of the ratio of the normal and tangential expansion components.

Figure 6:
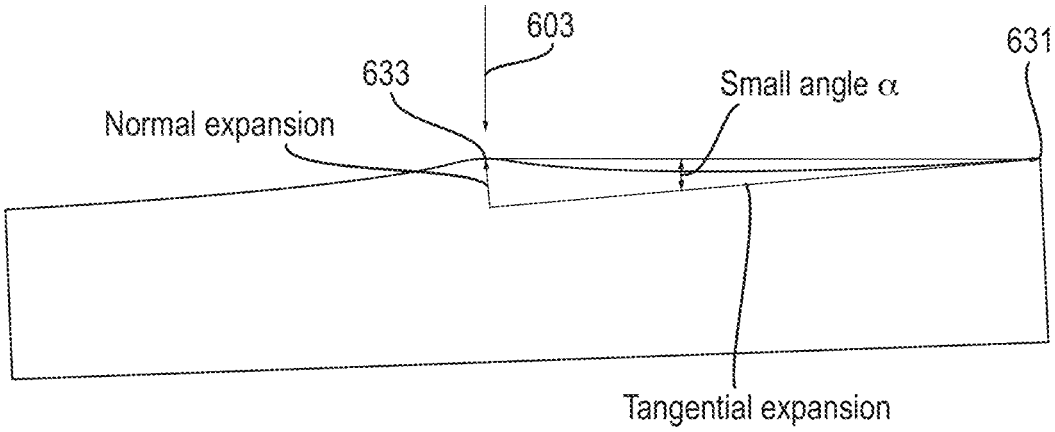
FIG. 6 shows a section of the target surface of a second example anode according to the invention.

FIG. 6 is a similarly exaggerated illustration of the surface profile of a second example anode, in which the target surface is tipped in relation to the electron beam. Thus as the heating occurs, the two movements cancel one another, and the position in space of the location on the target surface at which the electron beam 603 impinges when the anode is hot 633 is unchanged from the position in space of the location 631 on the target surface with which the beam intersects when the anode is cold. To maintain the original desired angle of the target in relation to the electron beam and the window of the X-ray tube, the body of the anode is tipped in the opposite direction to the small angle correction applied to the target surface.

Figure 7:
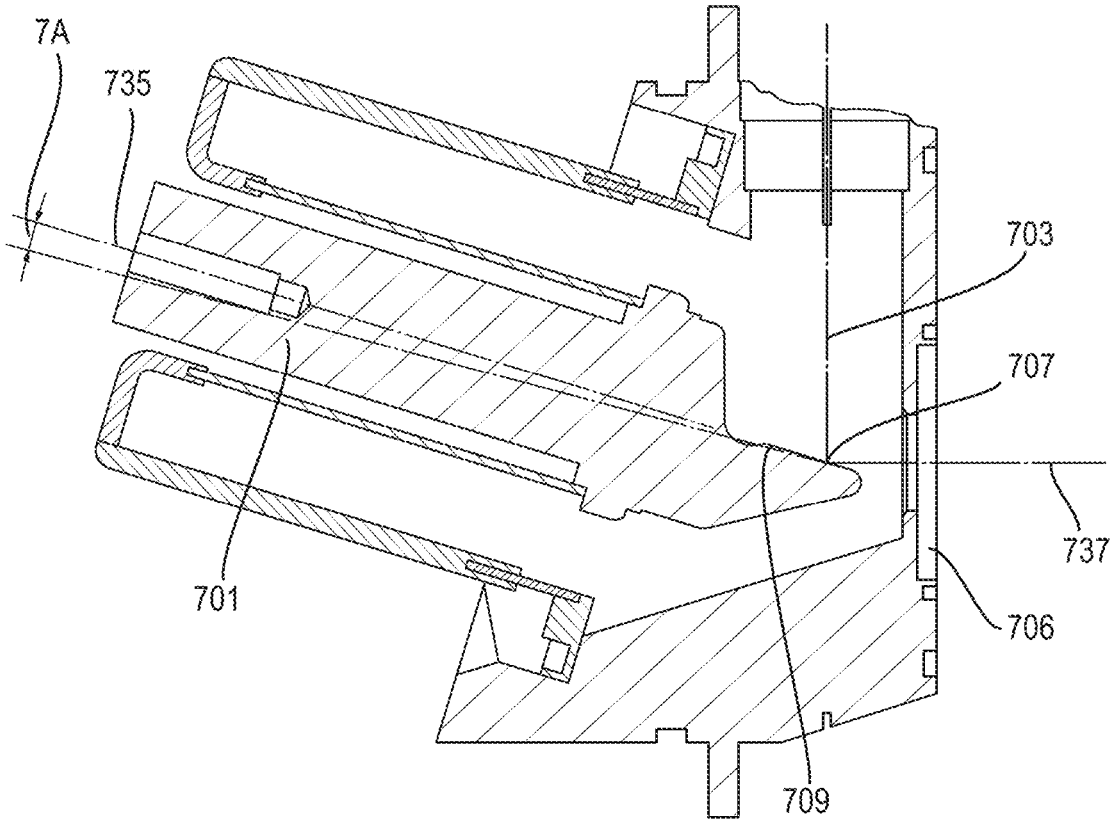
FIG. 7 shows a cross section view of the second example anode within an X-ray tube.

FIG. 7 accordingly shows the second example anode, which is similar to the first example anode, and includes a modification by way of this small tip angle being introduced into the design. Thus in the present example the target face 709 is no longer coplanar with the anode axis 735 but is tilted (anti-clockwise in the illustration). The anode body is tilted clockwise in order to maintain the relative angles between the target face electron beam and the window axis 737.

Figure 8:
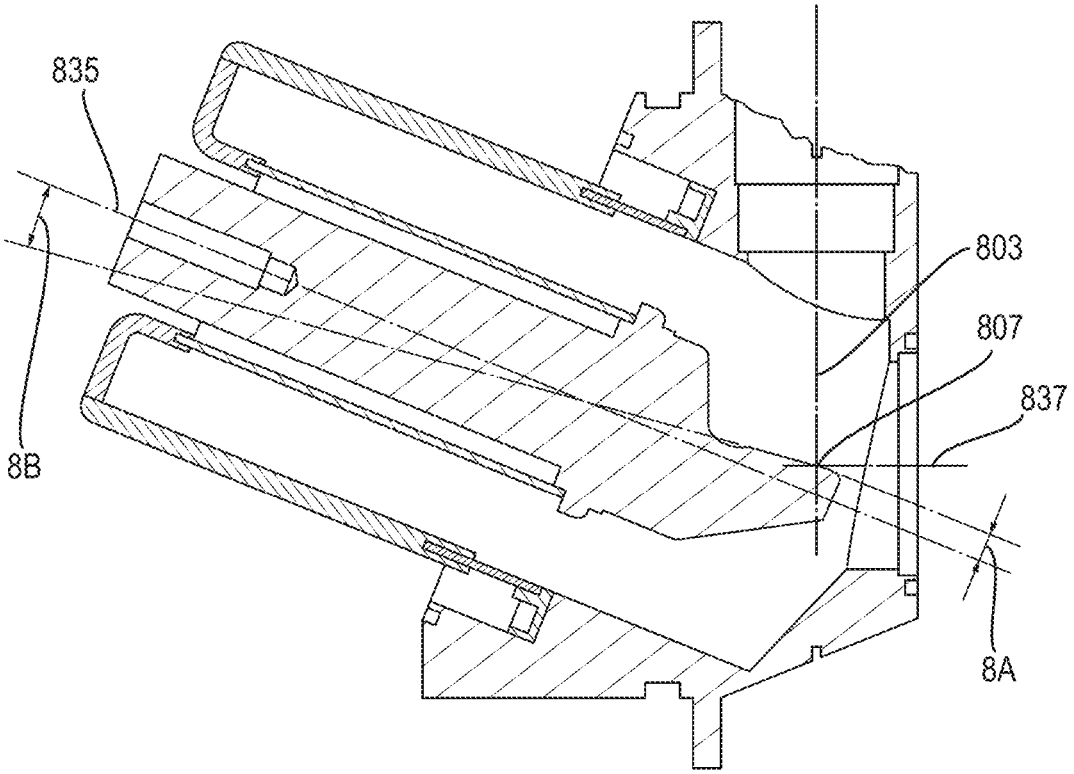
FIG. 8 shows a third example anode according to the invention within an X-ray tube.

In the first and second examples the focal spot 707 where the electron beam hits the target is coincident with the anode axis 723. FIG. 8 shows a third example, illustrative the more general case of arrangements in which the focal spot is not necessarily coaxial with the anode. By contrast with the previous examples, the third example anode includes additional material between the axis of the anode 835 and the spot location. The presence of this extra anode material causes additional thermal displacement of the target surface in a direction normal to the plane of the target. To maintain the advantageous, spot displacement-reducing configuration, this additional movement must be compensated for by introducing a larger tip angle $\beta$. Nonetheless, despite this requirement for a greater tip angle, it has been found that the effect of thermal expansion of the target can be successfully compensated for anodes with shapes such as that of the present example. As with the preceding examples, the anode is tipped in the opposite direction to the target tip angle, which maintains the desired angles between the electron beam 803 and the window central axis 837.

The preceding description of example anodes involves the second, operating state of the anode corresponding to a state of thermal equilibrium reached by the anode when operating at a given power level. However, it has been found by way of simulations that, even under a non-equilibrium condition, the thermal displacement of the surface of some example anodes is significantly reduced in comparison with the uncorrected, uncompensated movement experienced with conventional anodes. Uncompensated movement of the spot location can typically be several tens of microns in magnitude, whereas, even in a transient, non-equilibrium state, the spot movement of the spatial position of the focal spot for anodes according to the present disclosure is less than 10 microns. Thus for a given one of such anodes the second state may correspond to a non-equilibrium state at which the intersection of the target surface and the beam is substantially unmoved in space from its position at the first, comparatively unheated state.

Figure 9:
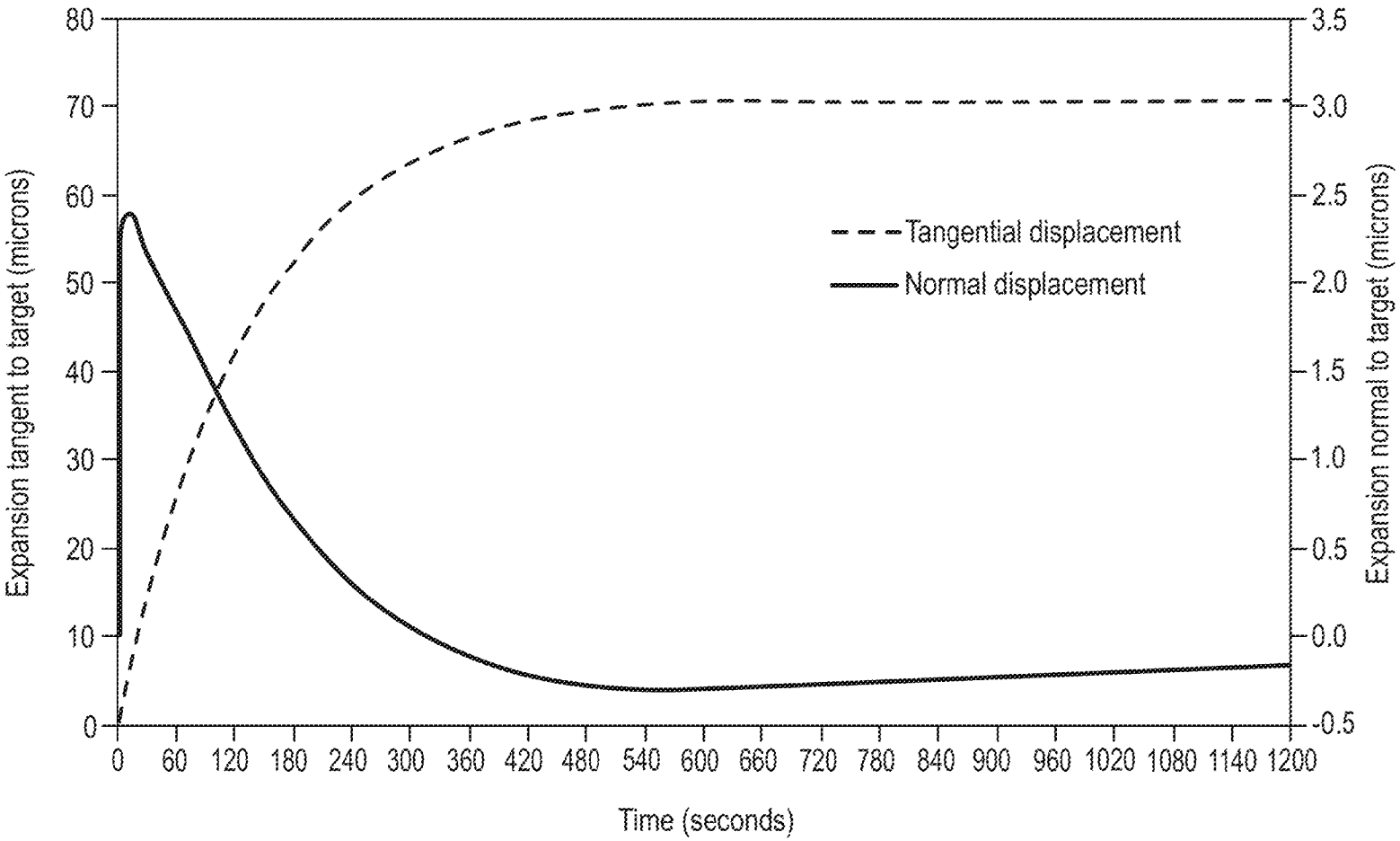
FIG. 9 is a graph showing displacement of an electron beam spot in use caused by thermal expansion of the third example anode.

FIG. 9 shows a graph of the thermal expansion of an anode similar to that of the third example, whereby the spot is not on-axis with the anode. The figure illustrates the normal and tangential components of thermal displacement of the focal spot for the anode, in which the initial intersection of the beam and the target surface is a distance of 5 mm from the anode axis, in use with an X-ray tube operating at 50 W over an operating period of 20 minutes. It can be seen that the greatest degree of expansion occurs during the first 10 minutes of that period, after which the movement largely subsides. Although the tangential movement of the target surface is large and is about 70 microns in the operating duration, this component does not contribute the spot movement, and so is not detrimental. The thermal movement of the spot in a direction normal to the target peaks, at approximately 2.4 microns, in about 10 seconds, and subsequently approaches zero over a duration of approximately 5 minutes. As alluded to above, the different time constants of these two movement components result from the different quantities of materials involved. The tangential motion of the spot involves the expansion of the entire anode, whereas the expansion of the spot normal to the target involves only a small amount of material directly under the spot.

The geometries of the examples depicted are in part based upon an assumption that, under thermal equilibrium, the X-ray tube component temperatures change in proportion to the applied power. This assumption leads to the configured anode shape including a target surface that is flat or linear along one direction, namely the principal axis of expansion. That is to say, the assumed movement of the surface both tangent and normal to the target is always in direct proportion to the applied power. However, because the removal of heat from the anode might, in practice, occur by way of a non-linear process, such as via convection, small residual errors in the surface location might occur when the power is at intermediate levels. In order to compensate for these small errors, the surface may be curved or shaped in such a way that the path defined across it is no longer linear. Linear shapes can additionally include cone-shaped targets, as used in rotating anodes such as those described later in this disclosure, as they have a linear cross section in one direction.

It will be understood that, beyond configuring an anode shape that substantially eliminates beam spot displacement between a first and second operating state, the above-described principles may also be applied in order to determine the exact shape of a surface which would compensate for thermal movement over intermediate operating points. However, typically a planar (or conical, in the case of rotating anodes) target surface is typically a more practical geometry, owing to difficulty in manufacturing other, more complex shapes. For example, the surface might be spherical, ellipsoidal or toroidal in shape, but would be so designed as to compensate for the non-linear behaviour of the X-ray tube as a function of power. A wide variety of target shapes are envisaged, which are constructed, positioned and oriented so as to cancel substantially the apparent movement of the beam spot attributable to thermal expansion of the anode and target.

Thus it is possible to mount anodes having such geometries within an X-ray tube and orienting the anode and target surface in such a way that the thermal expansion tangential to the target does not contribute to spot movement, and thermal expansion normal to the target is compensated for with that addition of a small tip angle. Because this target plane must typically be visible to the X-ray tube window from an angle in the range 5 to 45 degrees above the plane surface, the anodes can accordingly be mounted with their axis at an angle that is neither perpendicular to, nor parallel with, the desired direction of X-ray emission. This leads to the need for a modified X-ray tube device, in which the anode is mounted such that its axis is set at an angle in the range 5 to 45 degrees in relation to the desired angle of emission or X-ray window axis, or observation angle. For ease of construction, conventional X-ray tubes have anodes with axes that are either collinear with the X-ray window axis or observation angle, or the electron beam axis. Such conventional geometries are typically less suitable for use with anodes according to this disclosure. An X-ray tube can be constructed with a large X-ray window with an axis less than 5 degrees from the target plane or offset from the anode axis. However, observations must be made at an angle with respect to this axis. It will be understood that this is not an optimal geometry for practical purposes of mounting or X-ray collection. Therefore, the most optimal and useful geometries require an X-ray tube device that is adapted to accommodate an anode mounted at an angle that departs from the aforementioned arrangements used in conventional X-ray tube designs.

Figure 10:
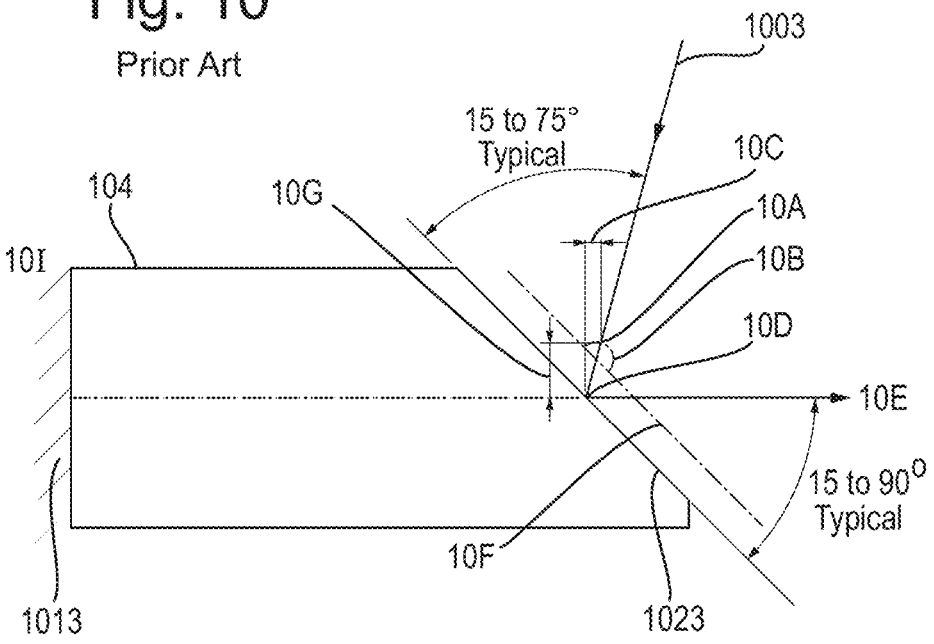
Fig. 10 Prior Art
FIG. 10 is a close-up schematic view showing the geometry of a target surface of a typical anode arranged in an "end window" configuration according to the prior art.
Figure 11:
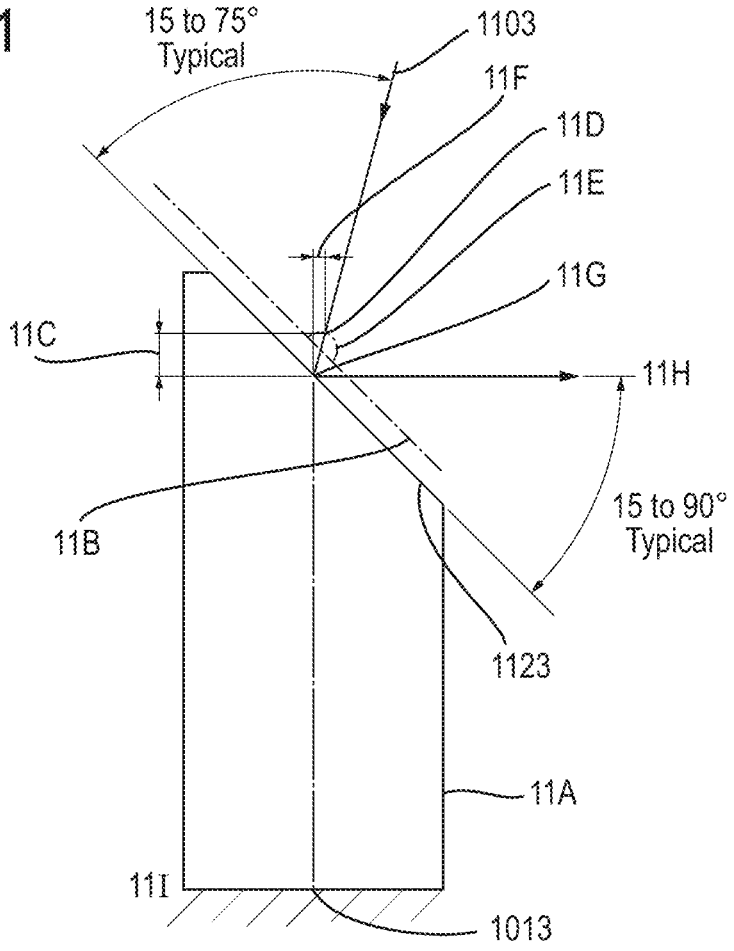
Fig. 11 Prior Art
FIG. 11 is a close-up schematic view showing the geometry of a target surface of an anode according to the prior art in a typical "side window" configuration.

The manner in which these examples reduce the spot movement effects from which conventional arrangements suffer is illustrated further by FIGS. 10-13. FIG. 10 and FIG. 11 show example anode geometries according to the prior art. FIG. 10 depicts a typical "end window" configuration, while FIG. 11 shows a typical "side window" configuration. In each case the orientation of the anode surface at the target region 1023, 1123 with respect to the direction in which the surface expands, owing to heating in use, away from the location 1013, 1113 at which the anodes are fixed to the X-ray tube is such that the intersection of the surface and the electron beam 1003, 1103 is caused to move relative to the X-ray tube. This causes the transverse spot movement, with respect to the X-ray detector direction, depicted in the figures.

Figure 12:
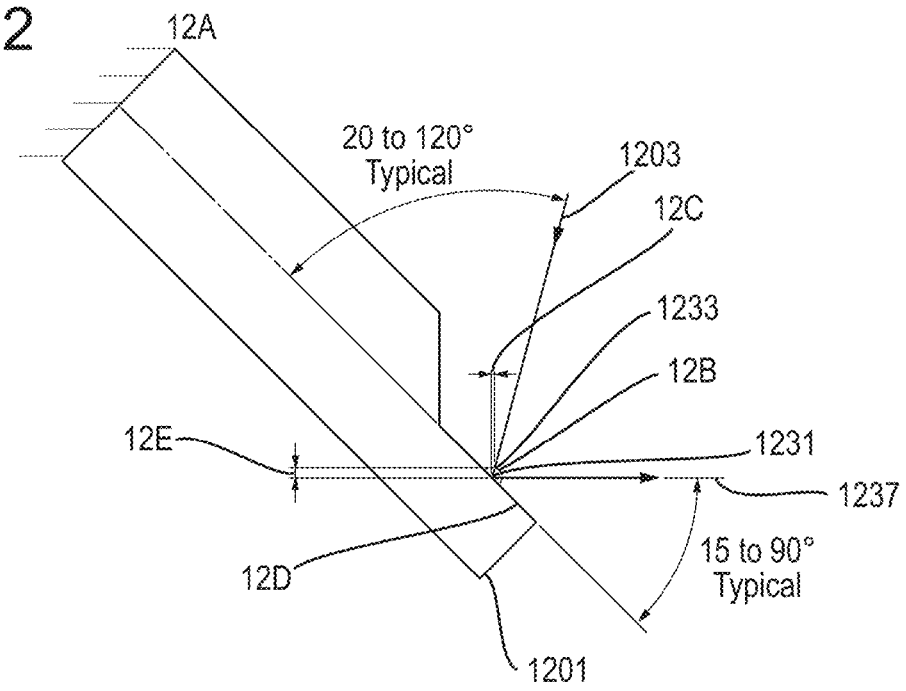
FIG. 12 shows part of an anode similar to the first example illustrating the geometry of the target surface in greater detail.
Figure 13:
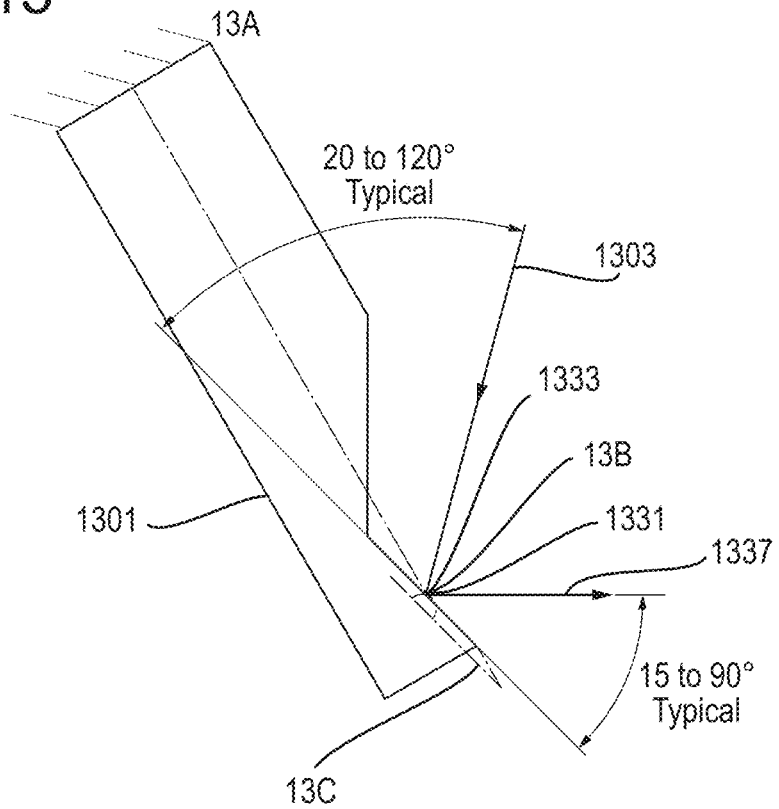
FIG. 13 shows part of an anode similar to the second example, depicting the geometry of the target surface in greater detail.

FIGS. 12 and 13 depict a part of an anode similar to the first example anode and the second example anode respectively. It can be seen that the transverse spot movement with respect to the window access 1237, 1337 is significantly reduced compared with the prior art comparative examples. In FIG. 12, the alignment of the principal expansion axis of material at the beam spot in the target region is aligned with the plane of the target region. Thus the principal component of the expansion experienced by the materials directly under the beam spot does not cause any transverse spot movement. However, in the example of FIG. 12, non-uniform thermal expansion causes a peak or bulge to form proximal to the electron beam 1203 intersection point as a result of surface heating. As a result, a small degree of axial spot movement, compared with the movement experienced in the prior art examples of FIGS. 10 and 11, occurs. Consequently the location of the beam spot when the anode is cold, or at its first state 1231 is slightly different from the spot location when the anode has been heated such that the peak forms 1233.

The corrective tilt described above in relation to the second example anode can be seen in FIG. 13 to compensate for the localised surface heating that causes the transverse spot movement shown in FIG. 12. The location of the beam spot at the first state 1331 has the same position and space as the location on the surface of the beam spot in the second, heated state 1333, as a result of the normal expansion component being cancelled by the tilt angle. The surface movement attributable to the bulk heating of the anode moves material away from the beam by the same amount as, but in the opposite direction to, the surface bulge that forms because of localised heating under the beam 1303.

Figure 14:
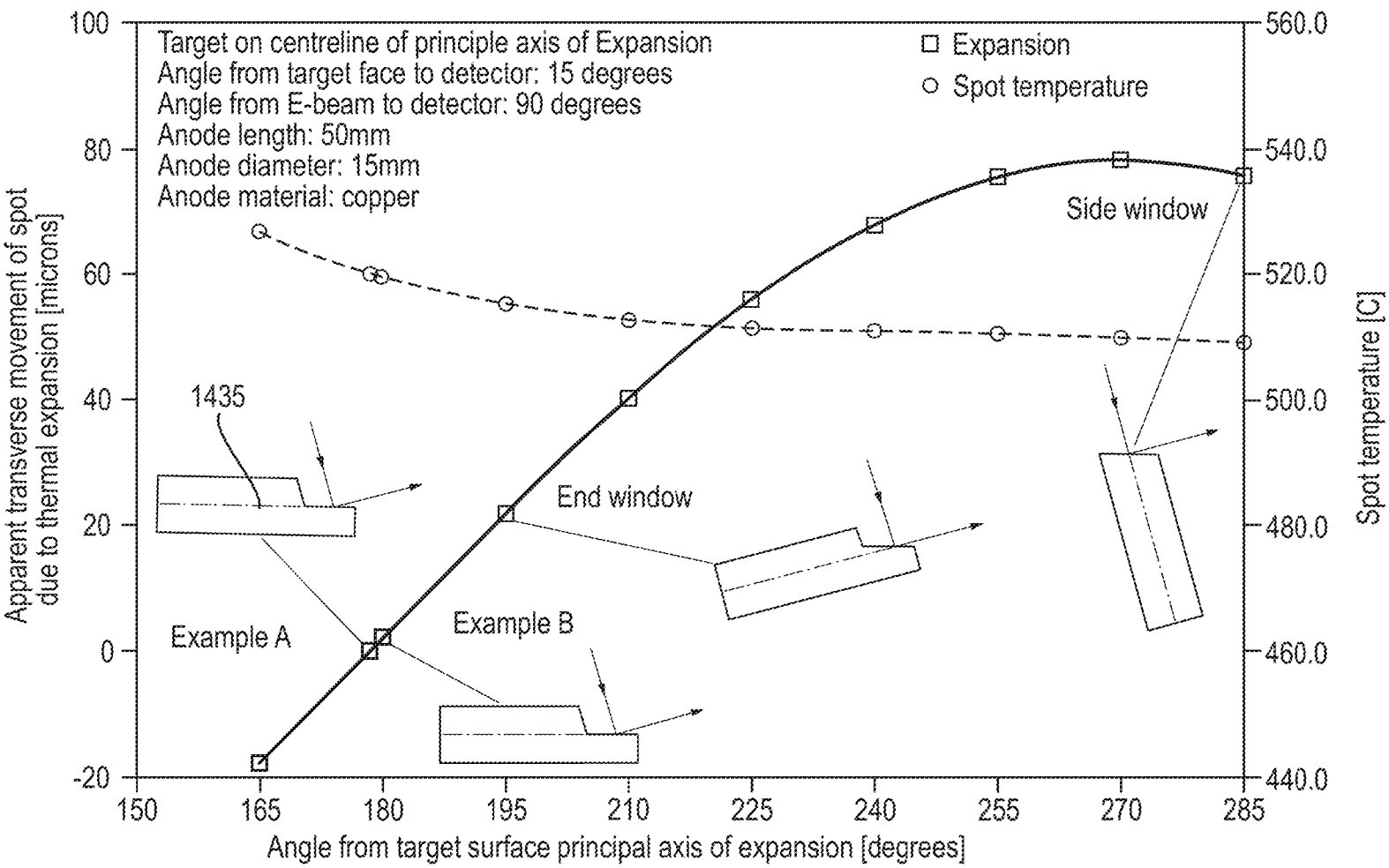
FIG. 14 and FIG. 15 each shows a graph visualising the apparent transverse movement of the beam focal spot as a function of the principal axis of expansion for various example anodes according to the invention and comparative examples.
Figure 15:
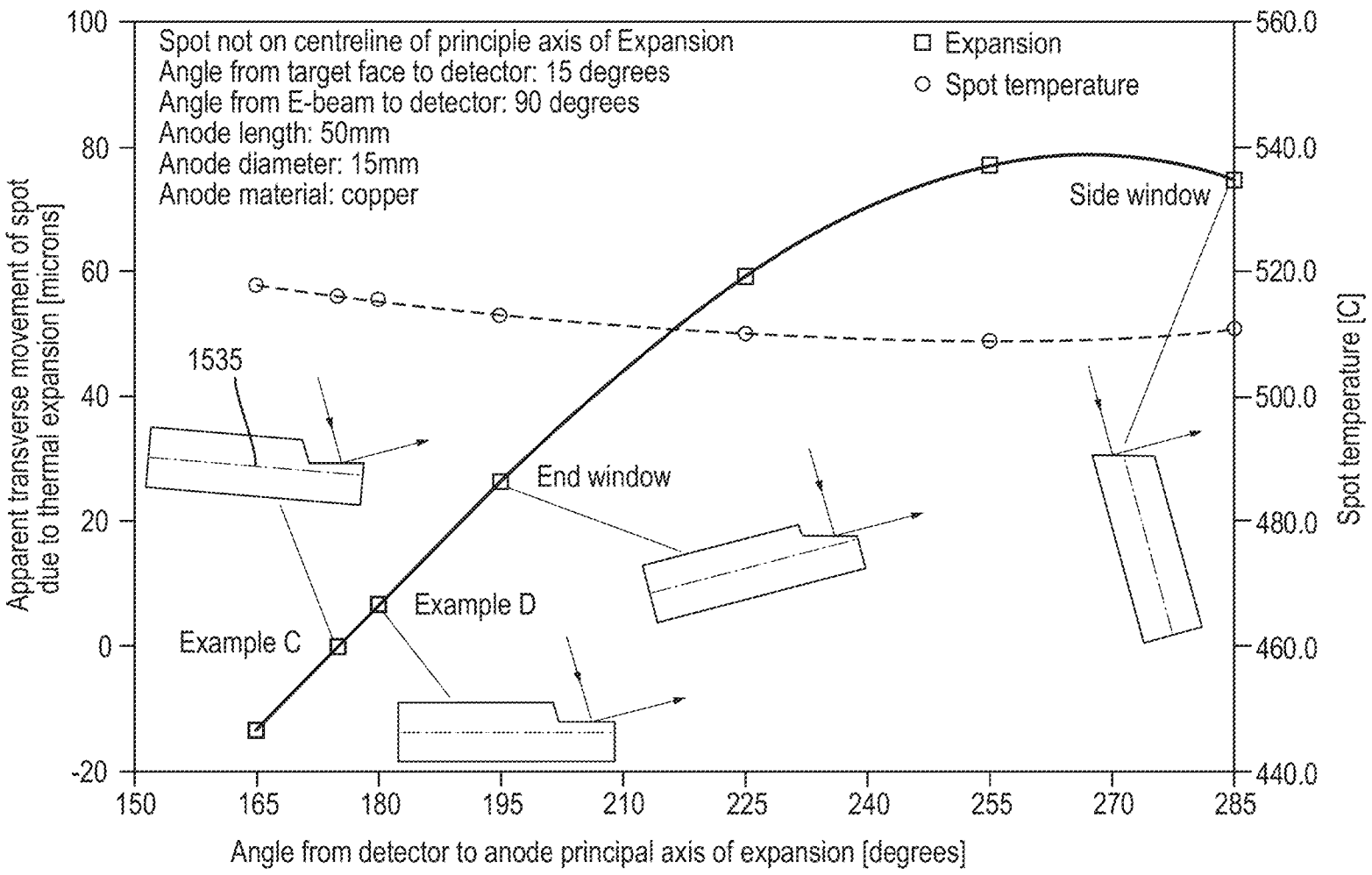

FIGS. 14 and 15 illustrate the effect of the orientation, with respect to the window axis or X-ray detector, of the principal axis of expansion of example anodes upon the observable transverse displacement of the focal spot caused by thermal expansion. The graphs demonstrate the advantageous effect achieved by examples according to this disclosure alongside comparative examples. The various examples are depicted together with their corresponding spot movement and temperature values for that geometrical configuration.

In the examples shown on the graph in FIG. 14, the anode geometry is such that the focal spot is coincident with the centre line of the anode 1435, principal axis of expansion. It can be seen that the 180-degree case, Example B, which corresponds to examples in this disclosure, produces transverse spot movement of less than 1/30 of the spot movement produced by the comparative example of the "side window" configuration, and 1/10 of the spot movement produced by the comparative example of the "end window" configuration. For the 178.45-degree case, Example A, which also corresponds to an example according to this disclosure, the transverse spot movement is eliminated entirely.

The graph additionally shows the effect of the expansion axis orientation upon the spot temperature under the example operating conditions shown. For Examples A and B the spot temperature is higher, owing to the presence of less anode material under the spot than in the comparative examples illustrated. However, it is possible to compensate for this effect and the resulting localized thermal expansion as described with reference to the following examples.

FIG. 15 similarly depicts the relationship between expansion axis orientation-spot movement relationship, for example anodes that are shaped such that the spot is not coincident with the centre line of the anode 1535. As a result of the offset spot location, Example D (the 180-degree case) according to the present disclosure produces transverse movement of only 1/10 of the spot movement produced by the "side window" comparative example and 1/4 of the spot movement produced by the "end window" comparative example. However, for Example C (the 174.92-degree case) according to this disclosure, the spot transverse movement is eliminated entirely, as with Example A. However, the high spot temperatures experienced with Examples A and B are not seen with Examples C and D. With the geometries of these examples in FIG. 15, the temperature is reduced by way of the extra anode material present beneath the beam spot permitting heat to be dissipated from that region at a faster rate.

Figure 16:
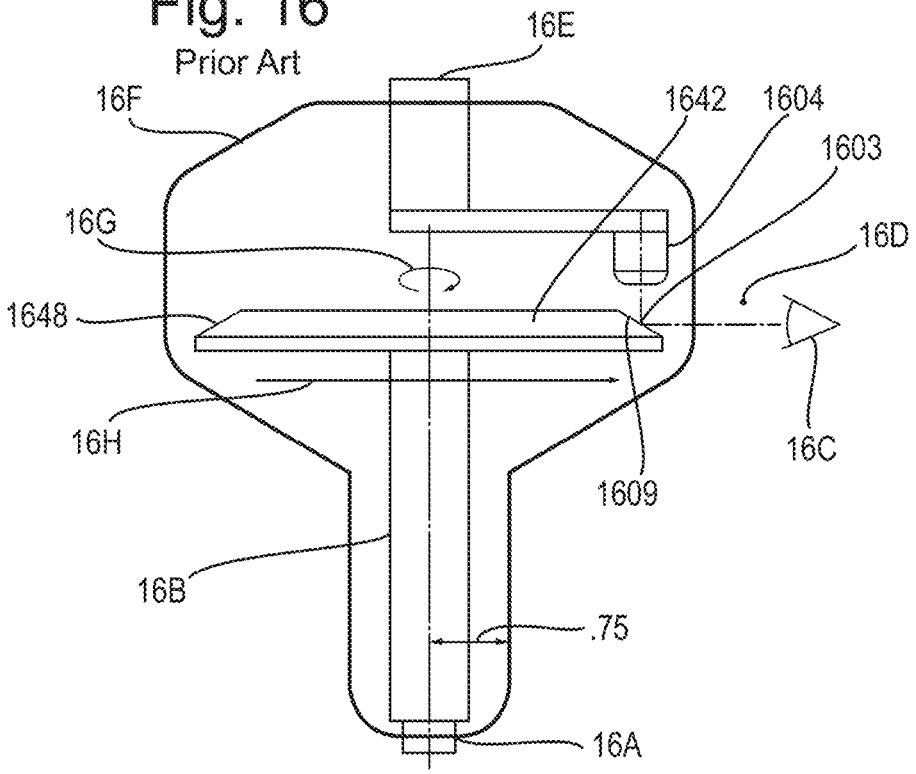
Fig. 16 Prior Art
FIG. 16 is a cross section view of a typical rotating-anode X-ray tube according to the prior art.

As alluded to above, the design principles applied in the preceding examples may also be applied to rotating-anode designs wherein the target face of a rotating anode X-ray tube is perpendicular to the axis of rotation and thermal expansion along the axis of rotation can be controlled by appropriate mounting methods. An example of a typical conventional rotating anode is shown in FIG. 16. Such designs include an anode 1642 adapted to spin about an axis of rotation that is parallel with the electron beam 1603. The target region 1609 of the surface under the beam at a given time is part of a truncated conical surface 1648. This surface moves due to thermal expansion in the depicted direction, causing X-ray spot movement as seen in conventional stationary-target X-ray tubes.

The following examples illustrate how the shapes of rotatable anodes, as with the stationary examples described above, may be configured so as to eliminate substantially the thermal beam spot movement.

Figure 17:
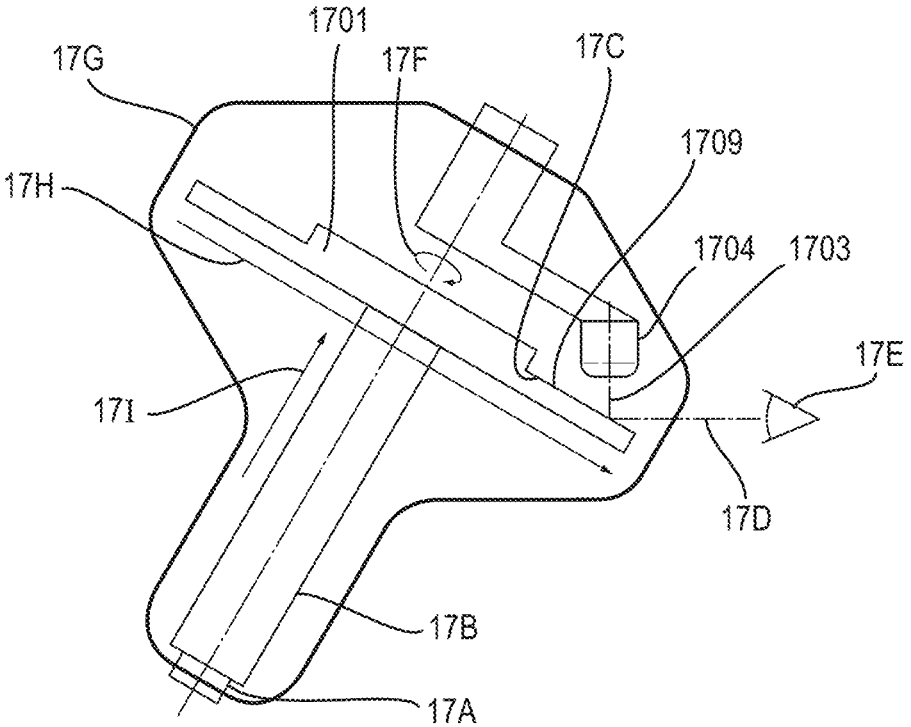
FIG. 17 is a cross section view of a fourth example anode according to the invention.

FIG. 17 shows a fourth example anode arranged in a rotating-anode X-ray tube similar to the convention or arrangement shown in FIG. 16, and applying the spot movement-reducing principles described above. In the present example the direction of thermal expansion of anode material on the target surface 1709 under the beam 1703 is radial with respect to the anode rotation axis. This is because the principal expansion experienced as the anode 1701 is heated in use is away from the central rotation axis around which the anode is rotatably mounted using the bearings and rotor schematically depicted, while the rotation mechanism is configured such that thermal expansion parallel to the rotation axis does not occur. This latter affect may be achieved by way of conventional, passive thermal expansion compensation techniques. Accordingly, the present example has a geometry adapted to eliminate radial thermal expansion, and is therefore shaped such that the target surface 1709 lies in a plane orthogonal to the rotation axis. This allows the movement of the beam spot that would be seen in relation to the instrument/observer axis to be substantially eliminated.

Figure 18:
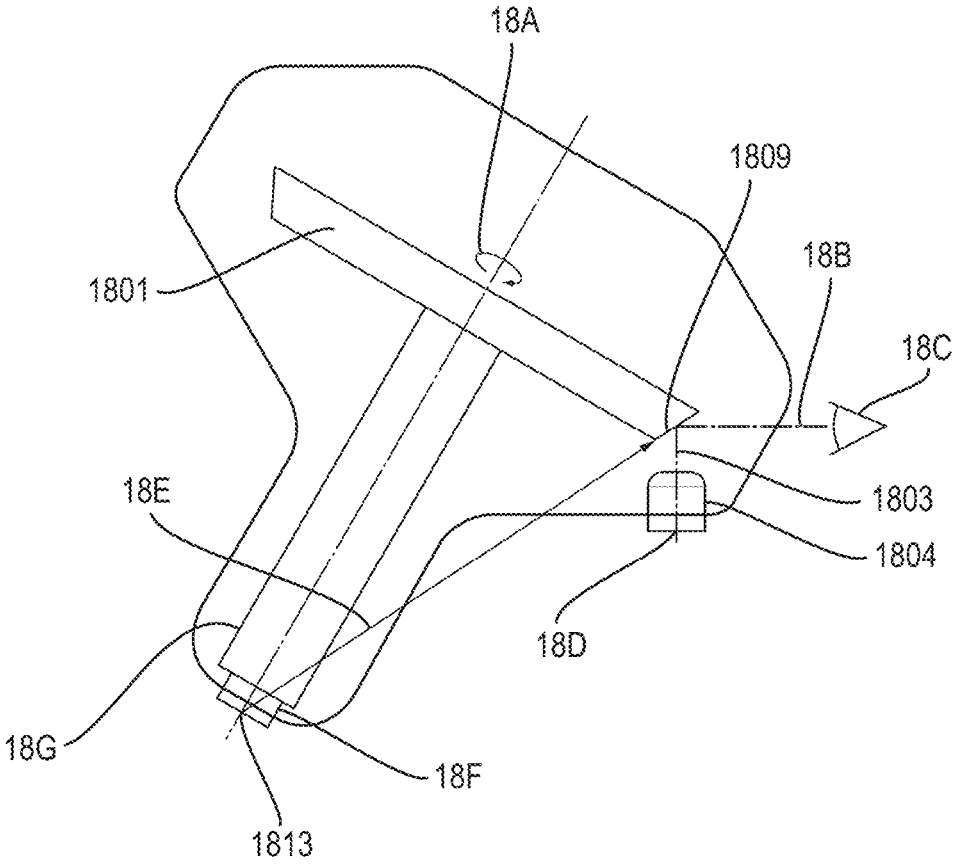
FIG. 18 is a cross section view of a fifth example anode according to the invention.

A fifth example anode according to the invention, which is also a rotating anode, is shown in FIG. 18. In this example, passive compensation techniques are not applied to the bearings and rotor part of the arrangement, and accordingly the geometry of the anode 1801 is adapted to compensate for a component of thermal expansion parallel to the rotation axis.

It can be seen that the target surface 1809 is therefore shaped so as to be aligned with the direction of thermal expansion away from the mounting location within the X-ray tube 1813. This conical section target surface, which is swept by the beam 1803 in use therefore allows the total elimination of thermal expansion beam spot displacement that would otherwise arise from a combination of radial and axial components.

Anode geometries such as these may be applied and, combined with conventional temperature compensation techniques (if necessary, using materials with differing coefficients of thermal expansion) applied to the anode mount, reduce spot movement relative to existing rotating anode designs.

Figure 19:
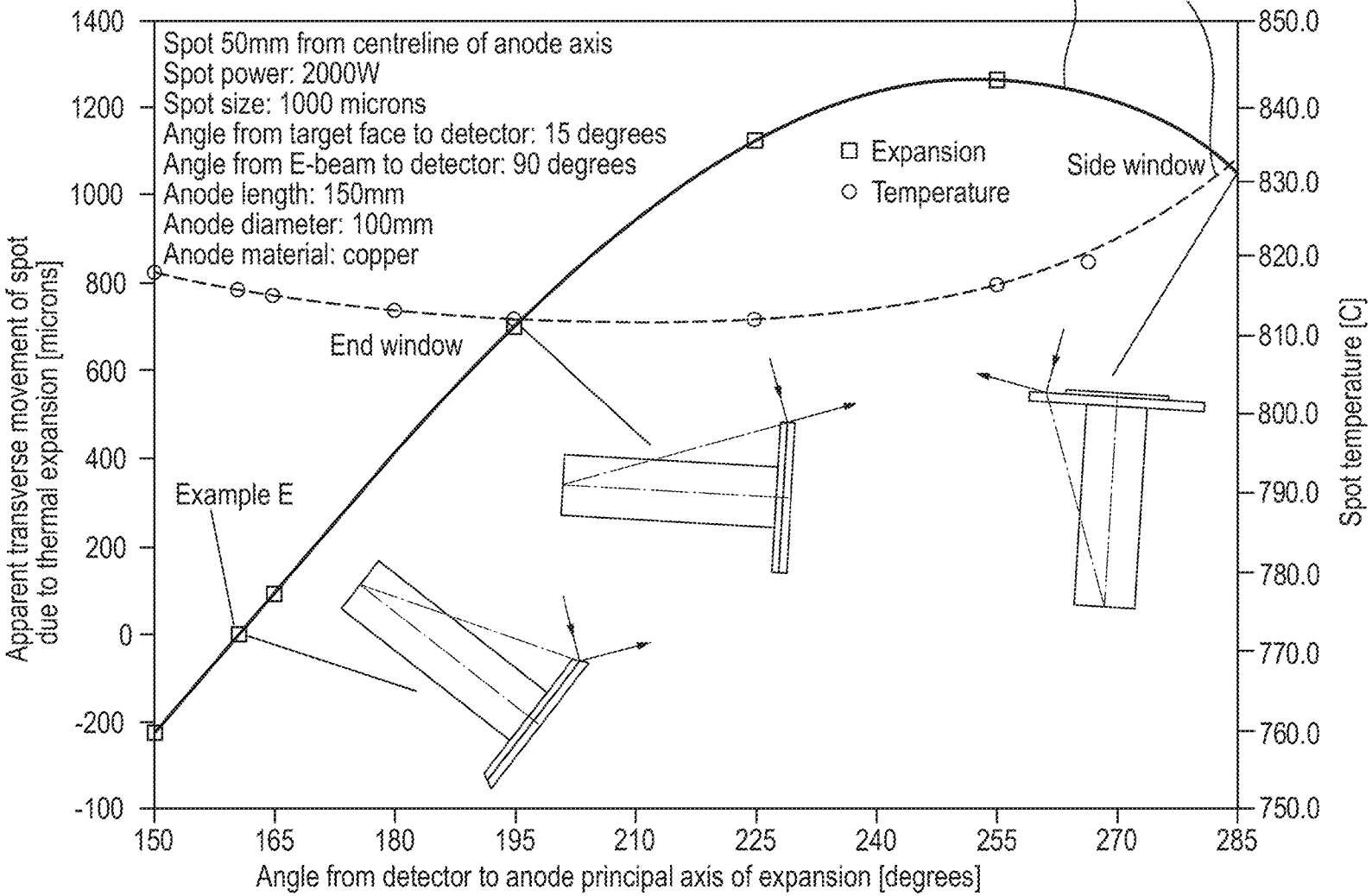
FIG. 19 is a graph visualising, for various examples according to the invention and comparative examples, of rotating-anode configurations, of the orientation of the principal expansion axis on the apparent transverse movement of the beam spot in use.

FIG. 19 shows, for rotating-anode examples according to the invention and comparative rotating anode examples, the effect of the anode geometry on visible spot movement in the same way as FIGS. 14 and 15. It has been found that, because of the non-uniform construction of the anode, aligning the principal axis of expansion with the target face (180-degree case) does not result in elimination of thermal displacement. Rather, this configuration produces a 40% reduction in spot movement, as illustrated. However, for Example E according to the present disclosure (the 160.64-degree case), the spot transverse movement is eliminated entirely.

An example method for determining an anode shape according to the preceding examples will now be described. For this example method, a number of initial assumptions are made: (1) There exists an electron beam with a well-defined central axis; (2) The central axis of the electron beam is fixed in space in relation to some virtual or real reference point on the exterior of the X-ray tube such as for example, the centre of an X-ray window or the centroid of all mounting locations; (3) At the instant of initial operation of the X-ray tube, called the initial state and corresponding to the first state in this example, with the X-ray tube at a uniform room temperature, the target surface location is fixed in space or that in the absence of vibration, a rotating target swept surface is fixed in space; (4) At the point of initial operation, the initial state, the electron beam strikes the target surface to form an X-ray spot and that the centroid of this spot is called the initial X-ray spot location; (5) There is significant heat produced by the X-ray spot in operation, and without proper heat management the target under the spot will melt or evaporate before the desired X-ray tube operating lifetime; (6) There is an anode which is affixed to or is a part of the X-ray target which performs two functions: (a) providing the electrical potential and conduct electrical current necessary to accelerate and capturing electrons from the electron beam, and (b) conducting heat away from the X-ray spot location; (7) There is a final operating state, corresponding to the second state in this example, such that either: (a) under steady operation, the target, anode, and X-ray tube approaches a steady state distribution of temperatures, or that (b) there is a well-defined repeatable final distribution of temperatures after an a priori known operating time; (8) The initial X-ray spot is defined as the intersection of the electron beam and the surface of the target. X-rays are also produced within the volume of the target. However, for the purpose of this design process it is only necessary to consider the X-rays produced at the surface of the target; (9) The electron beam need only intersect the surface at any desired angle necessary to achieve the spot size and shape desired. Scenario 1: In order to produce a spot on the surface which spreads out the electron beam energy, the electron beam axis will be chosen to be close to parallel with the surface. Scenario 2: In order to obtain a round spot on the target surface from an almost-round electron beam, the electron beam axis will be almost normal to the surface. That is to say, the angle is chosen to achieve the desired final X-ray spot characteristics, but a wide range of variants is envisaged; (10) The angle between the normal vector of the target surface at the spot centroid and the observation or exposure angle, or X-ray window axis, is also chosen to achieve the desired design goals. Scenario 1: Observation or exposure angles are chosen to be nearly normal to the target surface tend to have a higher X-ray flux. Scenario 2: Observation or exposure angles are closer to tangential to the surface and tend to produce an apparent spot which is foreshortened in one direction. That is, the angle is chosen to achieve the desired final X-ray output characteristics, but a wide range of variants is envisaged.

As explained earlier in this disclosure, the goal of the design process is to ensure that the initial-state spot centroid location, as defined above, coincides exactly in space with the final state spot centroid location on the target (or rotating anode swept target surface in the case of rotating-anode arrangements).

The present example design process proceeds in steps and is iterative:

Step 1. The design electron beam angle and observation angle are chosen as described in assumptions (7) and (8) above.

Step 2. The target surface orientation under the spot is chosen to satisfy the conditions in Step 1.

Step 3. A plane tangent to the initial condition target surface at the spot centroid is defined as the "target tangent plane".

Step 4. A single centroid of the anode mounting locations is chosen to be in the plane defined in Step 3 such that other conditions within the X-ray tube design are satisfied. For example, there is a general requirement for X-ray tubes, that the anode have a very high positive electrical potential relative to the electron gun and that there needs to be a sufficient thickness and length of insulation between the mounting locations and the electron gun and other parts of the X-ray tube to assure that this potential may be maintained without electrical breakdown. And yet, the end of the anode must be as close as possible to the spot to reduce the spot temperature in operation. The centroid of mounting locations and the centroid of the spot define a line which will be called the "principal axis of expansion".

Step 5. Having chosen a centroid and a mounting location for the anode, an anode material much as copper, which has a high thermal conductivity, is chosen to remove as much heat as possible over the length of the anode from the spot to some heat sink or heat exchanger on the opposite end of the anode. For rotating anodes, most of the heat is removed through radiation and so not all heat is removed through conduction. Most typical materials used in X-ray tubes will expand when heated and this causes the surface under the spot to move away from the centroid of the mounting location along the principal axis of expansion. It is in fact this property for conventional X-ray tubes where the target plane does not lie along the principal axis of expansion which causes the unwanted spot movement in existing designs. To an initial level of refinement, the design process according to this example can be ended at this stage. Most of the thermal expansion of the anode will be along this axis which in this invention at this step of the design, the expansion is coincident with the initial plane of the target and spot centroid.

Step 6. However, heating of the target and the anode are not uniform and while most thermal expansion occurs away from the anode mounting centroid, some expansion occurs normal to the target surface near the spot location and these subsequent steps will relate to compensating for that component of the thermal expansion.

Step 7. Because a greater cross-sectional area of conductive material along the heat conduction path reduces the temperature drop caused from heat dissipation at the spot, the centroid of the anode mounting locations can be offset from the principal axis of expansion to create more material near the spot location. This, however, results in additional expansion of the material under the spot away from the principal axis of expansion, and this must also be compensated for in the final, fully refined design. The offset is determined as a trade-off between the reduction in the spot temperature and the physical constraints on the exterior and interior dimension of the X-ray tube and the added complexity of the compensation mechanism outlined below.

Step 7. Either through numerical computer simulation, detailed theoretical calculation, approximation, or actual measurement, the intermediate spot location is then determined at the final operating state considering all thermal expansion of the target and anode as a whole. The spot location will not, in general, be in the initial target tangent plane. As thus calculated, this intermediate spot location will not be at the desired location of final refined embodiment. This is due to non-uniform heating and thermal expansion at and below the surface of the target.

Step 8. Having now determined the intermediate spot location, the normal distance from the intermediate spot centroid to the initial target tangent plane is determined and is now called distance "Y". Also, the distance along the original target tangent plane from the intermediate spot location to the original spot location is determined and is now called distance "X". These two distances are perpendicular to each other.

Step 9. A direction which is normal to the target tangent plane and points out of the target surface is defined as the "target normal". The direction from the spot centroid toward the anode mounting centroid is defined as the "principal direction". A direction is defined by the right-hand rule which is perpendicular to target normal and the principal direction and is in the plane of the target, and is in the direction defined by the target normal cross product with principal direction. A straight line in this direction which coincides with the spot centroid is defined as the "tilt axis".

Step 10. If the original target tangent plane was tilted by this "tilt angle" on the tilt axis by a positive amount equal to the arctangent of the ratio of Y over X, then as the target surface moves in a direction due to thermal expansion along the principal direction of expansion by an amount Y, the surface will have moved away from the original spot location an amount X. However, due to thermal expansion of the surface, the true surface of the target expands by exactly this amount X and so caries the spot back to its original location. So, the spot will not have moved at all in relation to the original initial location.

Step 11. However, if the target tangent plane is tilted as in Step 10 above, the original conditions from Step 2 will be violated. So, to keep the conditions from Step 2, the principal axis of expansion must be tilted in the opposite sense to compensating tilt angle. That is, the original target tangent plane is rotated by the tilt angle and the principal axis of expansion is rotated by a negative tilt angle. In this way, the original conditions for Step 2 are maintained and the target expands in such as way so that the original spot location and the final spot location coincide.

Step 12: Since in practice, a slight change to the relative location of the anode with respect to other parts of the X-ray tube may need non-trivial changes to the other components of the X-ray tube, the above Steps 7 through 11 are repeated until no further adjustments in the design are required. This concludes example design process, and anode having the specified shape may be formed and mounted within the X-ray tube in accordance with the determined geometry.

The invention claimed is:

1. An anode for an X-ray tube, wherein the anode has a shape configured such that, in use:

the electron beam impinges upon the anode at a focal spot in a target region on the anode, and at least a part of the surface of the anode within the target region lies substantially along a straight line coincident with the focal spot and parallel to a direction of thermal expansion of the anode at the focal spot, wherein the configured shape of the anode is such that:

non-uniform heating of the anode proximal to the focal spot causes the said part of the surface of the anode to lie substantially along the said straight line, and in absence of the said non-uniform heating, a predetermined deviation angle is subtended between the orientation of the said part of the surface of the anode and the said straight line, the predetermined deviation angle being configured to be substantially equal in magnitude to a change in inclination of the surface of the anode proximal to the focal spot caused by the said non-uniform heating.

2. An anode according to claim 1, wherein, in use, the straight line is coincident with a centroid of an attachment region of the anode at which the anode is attached to the X-ray tube.

3. An anode according to claim 2, wherein the anode is heated by the electron beam from a first state to a predetermined second state and undergoes resulting thermal expansion causing a change in the location of the focal spot on the surface of the anode, and the configured shape of the anode is such that the spatial position of the focal spot with respect to the X-ray tube is substantially the same for the first state and the second state.

4. An anode according to claim 3, wherein a distance between the spatial position of the focal spot with respect to the X-ray tube for the first state and the spatial position of the focal spot with respect to the X-ray tube for the second state is less than or equal to $6\times10^{-4}$ m.

5. An anode according to claim 3, wherein the second state corresponds to a predetermined temperature distribution within the anode that is achieved by way of the anode being heated under a predetermined set of heating conditions.

6. An anode according to claim 3, wherein the predetermined set of heating conditions comprises any one or more of: average anode temperature increase, total applied electron beam energy, average electron beam power, and electron beam impingement duration.

7. An anode according to claim 1, wherein a maximum distance between the said part of the surface of the anode within which the target region lies and the said straight line is less than $1.25\times10^{-3}$ m.

8. An X-ray tube comprising an anode according to claim 1.

9. A method of generating X-rays using an X-ray tube according to claim 8, the method comprising:

causing an electron beam to impinge upon the anode at a focal spot on the surface of the anode so as to generate X-rays and to heat the anode from the first state to the second state.

10. A method according to claim 9, further comprising continuing to operate the X-ray tube so as to generate X-rays, under a set of operating conditions whereby the anode is maintained at the second state.

11. An anode for an X-ray tube, wherein the anode has a shape configured such that, in use:

the electron beam impinges upon the anode at a focal spot in a target region on the anode;

the anode is heated by the electron beam from a first state to a predetermined second state; and at least a part of the surface of the anode within the target region lies substantially along a straight line coincident with the focal spot and parallel to a direction of thermal expansion of the anode at the focal spot, wherein the anode is adapted such that at least a portion of the anode, including the target region, is rotatable with respect to the X-ray tube when the anode is mounted within the X-ray tube, and wherein the configured shape of the anode is rotationally symmetrical such that, in use, during rotation of the said rotatable portion with respect to the X-ray tube, the spatial position of the focal spot with respect to the X-ray tube remains substantially the same for the first state and the second state.

12. A method of producing an anode for an X-ray tube, the method comprising:

configuring the shape of the anode, the said configuring comprising the steps of:

a) obtaining input anode shape data representative of a shape of an X-ray tube anode;

b) identifying, based on the input anode shape data, a first location, on the surface of the anode, of a focal spot at which an electron beam will impinge in use when the anode is at a first state;

c) identifying, based on the input anode shape data, a second location, on the surface of the anode, of the focal spot, when the anode, in use, is at a second state having been heated thereto by the electron beam from the first state and having undergone resulting thermal expansion such that the first and second locations on the surface of the anode are different;

d) generating, based on the input anode shape data and the identified first and second locations, modified anode shape data representative of a modified shape of an X-ray tube anode, wherein the spatial position, with respect to the X-ray tube, of the first location on the surface of the anode having the modified shape when the anode is at the first state is substantially the same as the spatial position, with respect to the X-ray tube, of the second location on the surface of the anode having the modified shape when the anode is at the second state, and forming an anode according to the modified anode shape data.

13. A method according to claim 12, wherein the generating modified anode shape data comprises: calculating a modification to the shape represented by the input anode shape data to reduce the distance between the location, with respect to the X-ray tube, of the first position on the surface of the anode having the modified shape when the anode is at the first state and the location, with respect to the X-ray tube, of the second position on the surface of the anode having the modified shape when the anode is at the second state; and applying the calculated modification to the input anode shape data so as to obtain the modified anode shape data.

14. A method according to claim 12, wherein the input anode shape data comprises a set of parameters having values, the parameters comprising: a window angle parameter representative of an angle between the anode axis and the window axis; and a target tilt parameter representative of and angle between the anode axis and the anode surface at the target region, and wherein the generating the modified anode shape data comprises adjusting the values of the window angle parameter and the target tilt parameter such that the angle between the window axis and the anode surface at the target region is unchanged.

15. A method according to claim 12, wherein the said configuring further comprises:

identifying, based on the input anode shape data, a straight line coincident with the focal spot and parallel to a direction of thermal expansion of the anode at the first position resulting from heating by the electron beam from the initial state;

and wherein the said generating is performed such that, for the shape represented by the modified anode shape data, at least a part of a target region in which the electron beam impinges on the surface of the anode in use lies substantially along the straight line when the anode is at the initial state.

* * * * *